US007571987B2

(12) United States Patent
Kosuge et al.

(10) Patent No.: US 7,571,987 B2
(45) Date of Patent: Aug. 11, 2009

(54) INK JET HEAD AND IMAGE RECORDING APPARATUS INCLUDING THE INK JET HEAD

(75) Inventors: Takaaki Kosuge, Kaisei-machi (JP); Yasuhisa Kaneko, Kaisei-machi (JP)

(73) Assignee: Fujifilm Corporation, Tokyo (JP)

( * ) Notice: Subject to any disclaimer, the term of this patent is extended or adjusted under 35 U.S.C. 154(b) by 437 days.

(21) Appl. No.: 11/604,339

(22) Filed: Nov. 27, 2006

(65) Prior Publication Data

US 2007/0120900 A1 May 31, 2007

(30) Foreign Application Priority Data

Nov. 29, 2005 (JP) ..... 2005-343434

(51) Int. Cl.
*B41J 2/04* (2006.01)

(52) U.S. Cl. ..... 347/54; 347/55

(58) Field of Classification Search ..... 347/20, 347/44–47, 54, 55, 73–78
See application file for complete search history.

(56) References Cited

U.S. PATENT DOCUMENTS 6,336,707 B1 * 1/2002 Asai et al. ..... 347/46

FOREIGN PATENT DOCUMENTS

JP 10-230608 A 9/1998
JP 11-268276 A 10/1999
JP 2003-175612 A 6/2003

* cited by examiner

*Primary Examiner*—Juanita D Stephens
(74) *Attorney, Agent, or Firm*—Birch, Stewart, Kolasch & Birch, LLP

(57) ABSTRACT

The ink jet head ejects ink droplets by exerting an electrostatic force on ink having dispersed charged particles, and includes an insulating ejection substrate having through holes, ejection electrodes, each being arranged in each through hole and ink guides, each passing through each through hole. Each ink guide includes a support part and a tip end part that extends from an end portion of the support part, the tip end part is formed so that a back surface of the tip end part is flush with a back surface of the support part, and the tip end part is thinner than the support part to form a step on a front surface side and is gradually narrowed toward the ink droplet ejection side, and the electrostatic force has at least a component directed toward a tip end of an ink guide along the tip end part. The image recording apparatus includes the ink jet head and records an image on a recording medium.

12 Claims, 13 Drawing Sheets

FIG. 3A
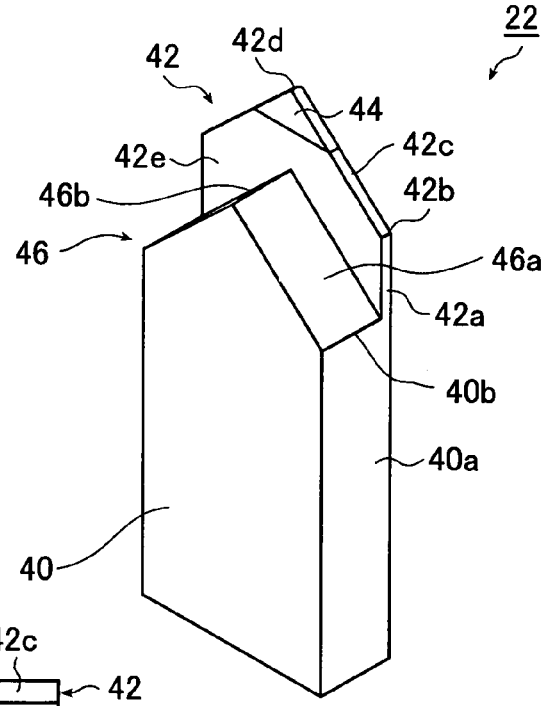
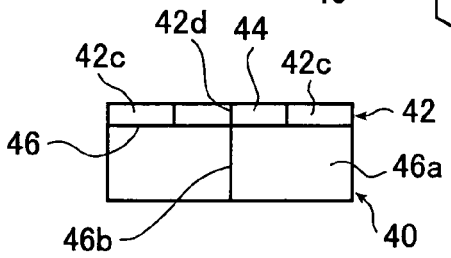
FIG. 3D
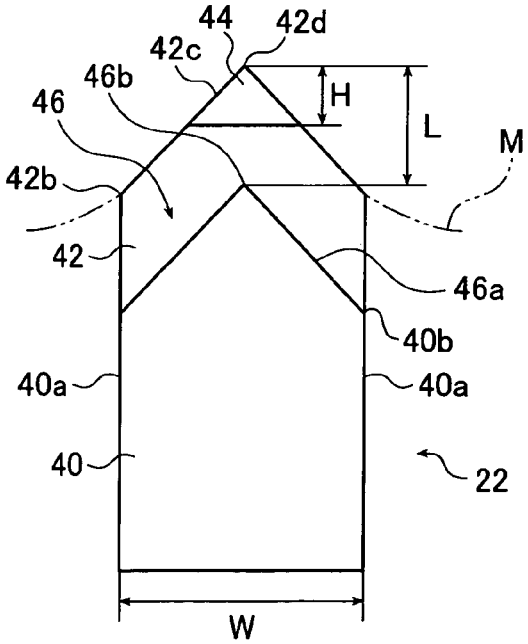
FIG. 3B
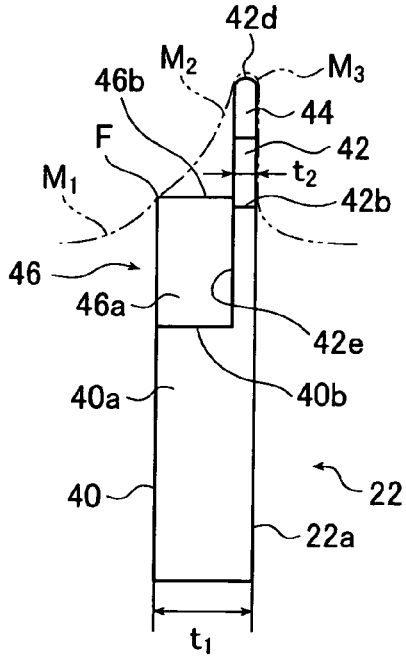
FIG. 3C

FIG. 4
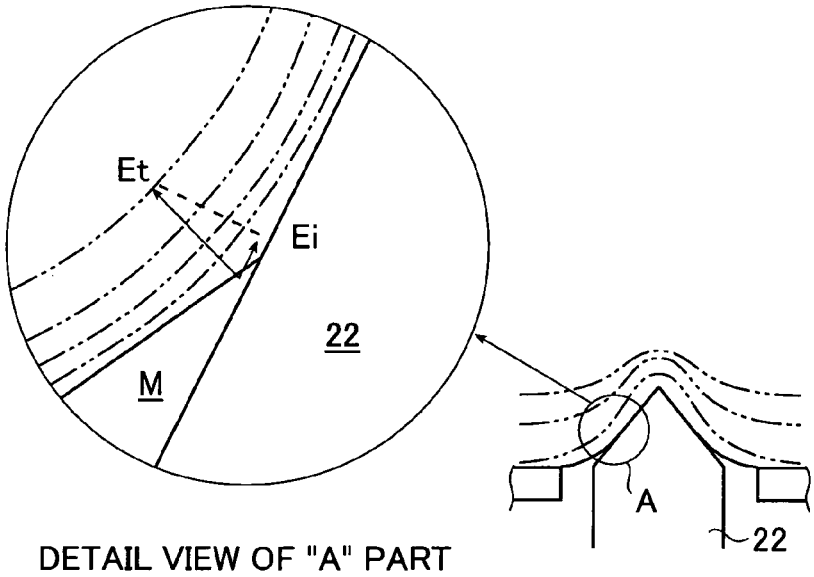
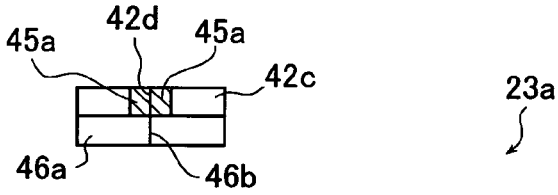
FIG. 5C
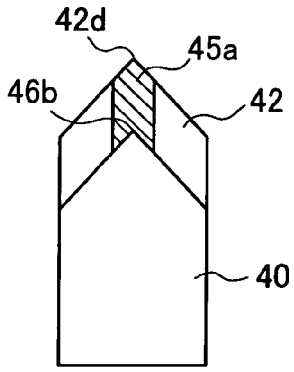
FIG. 5A
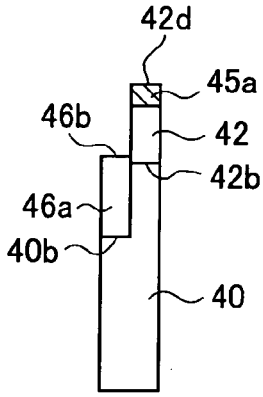
FIG. 5B

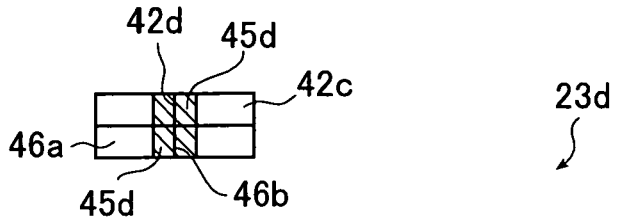
FIG.8C
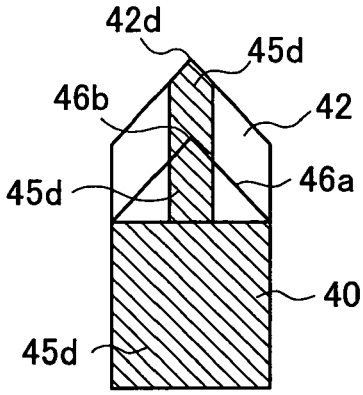
FIG.8A
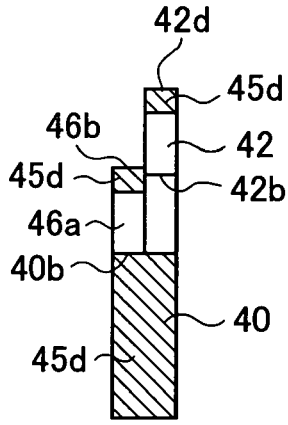
FIG.8B
FIG.18
PRIOR ART
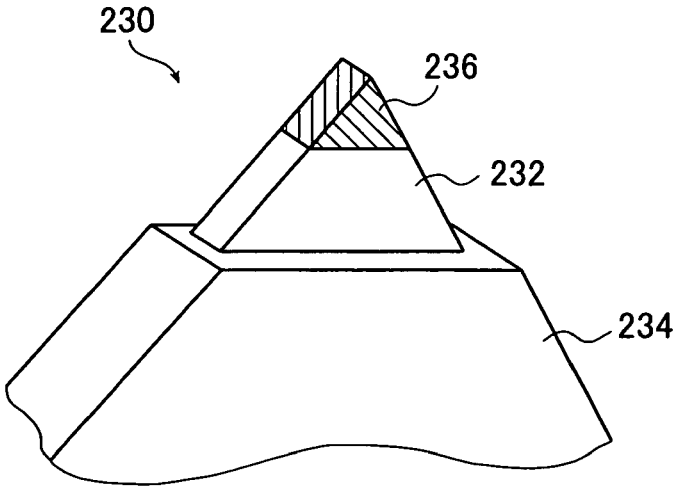

FIG.9E"

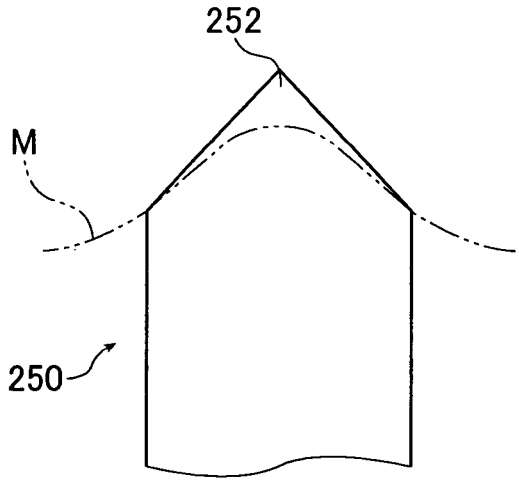
FIG.16A
PRIOR ART
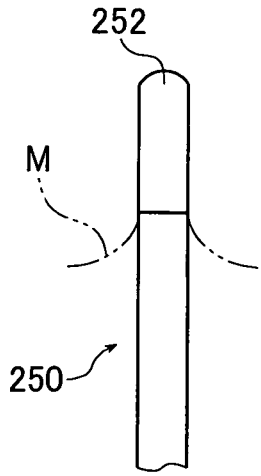
FIG.16B
PRIOR ART
FIG.17
PRIOR ART
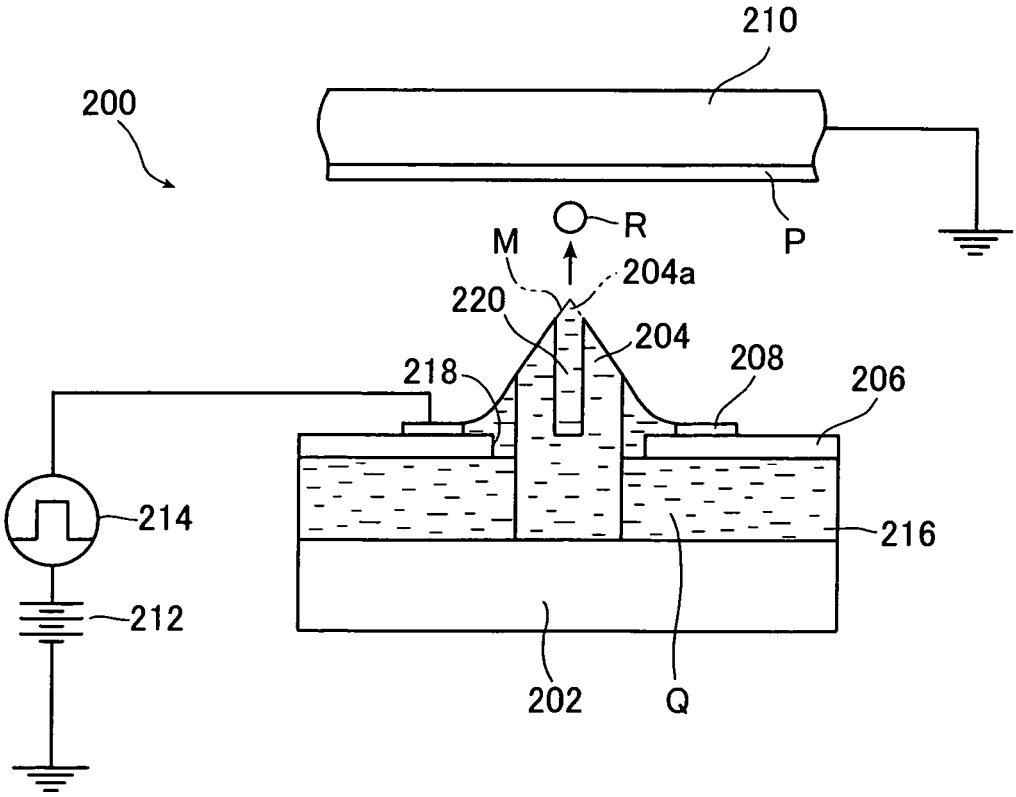

INK JET HEAD AND IMAGE RECORDING APPARATUS INCLUDING THE INK JET HEAD

The entire contents of the documents cited in this specification are herein incorporated by reference.

BACKGROUND OF THE INVENTION

The present invention belongs to an ink jet head and an image recording apparatus including the ink jet head, and relates to an ink jet head that ejects ink droplets by exerting electrostatic force on ink in which charged particles are dispersed, and an ink jet image recording apparatus which includes the ink jet head and forms an image by ejecting the ink droplets. More particularly, the present invention relates to an ink jet head that is capable of maintaining a meniscus at a high position and has improved ejection responsivity, and an image recording apparatus using the ink jet head.

Known examples of ink jet heads for performing image recording (drawing) by ejecting ink droplets include a so-called thermal ink jet head that ejects ink droplets by means of expansive force of air bubbles generated in ink through heating of the ink, and a so-called piezoelectric-type ink jet head that ejects ink droplets by giving pressure to the ink using piezoelectric elements.

In the case of the thermal ink jet head, however, the ink is partially heated to 300° C. or higher, so there arises a problem in that a material of the ink is limited. On the other hand, in the case of the piezoelectric-type ink jet head, there occurs a problem in that a complicated structure is used and an increase in cost is inevitable.

Known as an ink jet head that solves the problems described above is an electrostatic ink jet head which uses ink containing charged colorant particles (fine particles), exerts electrostatic force on the ink, and ejects ink droplets by means of the electrostatic force (for example, refer to JP 10-230608 A, JP 11-268276 A, and JP 2003-175612 A).

The electrostatic ink jet head includes an insulating ejection substrate in which many through holes (i.e., ejection ports) for ejecting ink droplets are formed, and ejection electrodes that respectively correspond to the ejection ports, and ejects ink droplets by exerting electrostatic force on the ink through application of predetermined voltages to the ejection electrodes. More specifically, with this construction, the ejection head ejects the ink droplets by controlling on/off of the voltage application to the ejection electrodes (i.e., driving ejection electrodes by modulation) in accordance with image data, thereby recording an image corresponding to the image data onto a recording medium.

An example of such electrostatic ink jet head is disclosed in JP 10-230608 A as an ink jet head 200. As conceptually shown in FIG. 17, the ink jet head 200 includes a support substrate 202, an ink guide 204, an ejection substrate 206, an ejection electrode 208, a bias voltage source 212, and a signal voltage source 214.

In the ink jet head 200, the support substrate 202 and the ejection substrate 206 are each an insulating substrate and are arranged to be spaced apart from each other by a predetermined distance.

Many through holes (i.e., substrate through holes) that each serve as an ejection port 218 for the ink droplets are formed in the ejection substrate 206, and a gap between the support substrate 202 and the ejection substrate 206 serves as an ink flow path 216 for supplying ink Q to the ejection port 218. In addition, the ring-shaped ejection electrode 208 is provided to the upper surface of the ejection substrate 206 (i.e., surface of the ejection substrate 206 on the side from which ink droplets R are ejected) to surround the ejection port 218. The bias voltage source 212 and the signal voltage source 214 serving as a pulse voltage source are connected to the ejection electrode 208, which is grounded through the voltage sources 212 and 214.

On the other hand, the protruding ink guide 204 is provided to the support substrate 202 so as to correspond to each ejection port 218. The ink guide 204 extends through the ejection port 218 and protrudes from the ejection substrate 206. A tip end part 204*a* of the ink guide 204 has a protruding shape, and an ink guide groove 220 for supplying the ink Q to the tip end part 204*a* is formed by cutting out the tip end part 204*a* by a predetermined width.

In an ink jet recording apparatus using such ink jet head 200 described above, at the time of image recording, a recording medium P is supported by a counter electrode 210.

The counter electrode 210 functions not only as a counter electrode for the ejection electrode 208 but also as a platen for supporting the recording medium P at the time of the image recording, and is arranged to face the upper surface of the ejection substrate 206 and to be spaced apart from the tip end part 204*a* of the ink guide 204 by a predetermined distance.

In the ink jet head 200, at the time of the image recording, a not-shown ink circulation mechanism causes the ink Q containing the charged colorant particles (i.e., charged particles) to flow in the ink flow path 216 in a direction, for instance, from the right side to the left side in FIG. 17. Note that the colorant particles of the ink Q are charged to the same polarity as the voltage applied to the ejection electrode 208.

The recording medium P is supported by the counter electrode 210 and faces the ejection substrate 206.

Further, a DC voltage of, for example, 1.5 kV is constantly applied by the bias voltage source 212 to the ejection electrode 208 as a bias voltage.

As a result of the ink Q circulation and the bias voltage application, and by the actions of surface tension of the ink Q, capillary phenomenon, electrostatic force due to the bias voltage, and the like, the ink Q is supplied from the ink guide groove 220 to the tip end part 204*a* of the ink guide 204, a meniscus M of the ink Q is formed at the ejection port 218, the colorant particles move to the vicinity of the ejection port 218 (migrates under the electrostatic force), and the ink Q is concentrated in the ejection port 218 or the tip end part 204*a*.

In this state, when the signal voltage source 214 applies a pulse-shaped drive voltage of, for example, 500 V corresponding to image data (i.e., drive signal) to the ejection electrode 208, the drive voltage is superimposed on the bias voltage and the supply of the ink Q to the tip end part 204*a* and its concentration are promoted. When movement force of the ink Q and the colorant particles to the tip end part 204*a* and attraction force from the counter electrode 210 to the ink Q and the colorant particles exceed the surface tension of the ink Q, a droplet of the ink Q (i.e., ink droplet R) in which the colorant particles are concentrated is ejected.

The ejected ink droplet R moves owing to momentum at the time of the ejection (i.e., impetus, and inertial force) and the attraction force from the counter electrode 210, adheres to the recording medium P, and forms an image thereon.

The ink jet heads disclosed in JP 11-268276 A and JP 2003-175612 A also each have a similar configuration and operation to those of the ink jet head 200 shown in FIG. 17 except for the structure of the ink guide.

As described above, the electrostatic ink jet head ejects the ink droplets R by controlling a balance between the surface tension of the ink Q and the electrostatic force exerted on the ink Q.

Accordingly, in order to perform the ejection of the ink droplets at a low drive voltage and a high speed (i.e., high recording (ejection) frequency) with stability, the ink guide provided for each ejection port is an important factor. Thus, the ink guide is required to be capable of appropriately stabilizing the meniscus of the ink at the ejection port (hereinafter referred to as a "meniscus stability") by suitably guiding the ink thereto, and of favorably concentrating the electrostatic force (hereinafter referred to as a "electric field concentrating capability").

In order to achieve such properties, in the electrostatic ink jet head, the ink guide is formed in various manners.

For instance, in the ink jet head disclosed in JP 10-230608 A, as the ink jet head 200 shown in FIG. 17, the tip end part 204*a* of the ink guide 204 is has a cutout having a predetermined width, which serves as the ink guide groove 220 for supplying the ink Q to the tip end part 204*a*. In such ink jet head, by cutting out the tip end part 204*a* of the ink guide 204 to form the ink guide groove 220 having a predetermined width, capability of supplying the ink Q to the tip end part 204*a* of the ink guide 204 is further improved.

Further, in the ink jet head 200 disclosed in JP 10-230608 A, in order to make the colorant particles chargeable due to the induced current generated when applying current to the ejection electrode 208, the following treatment is applied to the ink guide 204 which is made of a material such as plastic resin. That is, the whole surface of the ink guide 204 is covered with a conducting copper film by sputtering or the like. Alternatively, the ink guide 204 is made of a conductive material. Still alternatively, at least the tip portion of the ink guide 204 is made conductive. Also, the insulating part electrically insulates adjacent ink guides from each other.

In the ink jet head disclosed in JP 11-268276 A, the ink guide is made of a single material such as an insulating resin like polyimide or ceramic. Further, similarly to the ink guide shown in FIG. 17, the ink guide has a slit-like ink guide groove whose tip end part has a protruding shape and which is obtained by cutting out a part of the ink guide.

In the ink jet head disclosed in JP 2003-175612 A, in order to perform efficient concentration of the electric field in the tip end part of the head while ensuring the necessary dielectric constant and maintaining moldability of the tip end part of the head (or ink guide) at which the electric field needs to be concentrated, as shown in FIG. 18, an ink guide 230 includes a tip end part (i.e., ejection part) 232 having an extreme tip end portion 236 at which a meniscus is formed by the ink supplied, and a support part 234 for supporting the ejection part 232. The whole ink guide 230 is molded from a resin material having a low dielectric constant (e.g., equal to or lower than 4), and the extreme tip end portion 236 of the ejection part 232 is made of a material having a dielectric constant higher than that of the other portions (e.g., equal to or higher than 7). Further, the ejection part 232 of the ink guide 230 is made thin in comparison with the support part 234, and the extreme tip end portion 236 is sharpened. Whereby, the ejection part 232 obtains high electric field strength so as to serve as an ink ejection point.

As described above, in order to obtain the ink guide capable of stably holding a favorable meniscus, preferably, the ink guide has excellent moldability, and is molded with high definition so as to properly guide the ink.

In order to carry colorant particles to the guide tip end part, a favorable meniscus needs to be formed so that the tip end part is wetted with the ink.

In JP 10-230608 A and JP 11-268276 A, as the ink guide 204 shown in FIG. 17, the protruding tip end part 204*a* stabilizes the ink ejection point, the ink guide groove 220 is formed in the tip end part 204*a*, and the ink is stably supplied to the ink ejection point by utilizing capillary action in the ink guide groove 220, whereby the meniscus M is held at a high position. In the above-described manner, in JP 10-230608 A and JP 11-268276 A, the protruding guide tip end and the ink guide groove allow the ink to be stably supplied to the guide tip end to jet the ink droplets with stability.

SUMMARY OF THE INVENTION

However, since the tip end part 204*a* in the ink guide 204 of this structure has a cutout, there is a problem in that the sharpness of the tip end part 204 is low, and the size of the ink droplets capable of being ejected is limited.

Also, since the tip end part 204*a* in the ink guide 204 of this structure has a cutout, the tip end shape of the ink guide 204 is determined by the ink Q. Therefore, the tip end shape is determined by the surface tension of the ink Q used and the pressure exerted on the ink Q. The tip end shape obtained by the ink Q fluctuates due to disturbances such as vibrations or supply of the ink Q for replenishment of the ink Q consumed through ejection of the ink droplets R. Therefore, there is a problem in that ink adhering position accuracy is lowered, so that it is almost impossible to form an image with stability and at high resolution.

Further, there is a problem in that it is difficult to reduce the width of the tip end part of the ink guide from the viewpoint of machining. Still further, the ink guide 204 requires forming the ink guide groove 220 therein, so machining becomes particularly difficult when the width of the tip end part is reduced.

In JP 10-230608 A, since the protruding ink guide is formed so that at least the surface of the guide tip end part has electric conductivity, the surface of the guide tip end part is chargeable due to the induced current generated when applying current to the ejection electrode. Such guide tip end and ink guide groove allow the ink to be stably supplied to the guide tip end to eject the ink droplets with stability.

However, in JP 10-230608 A, although at least the guide tip end part has electric conductivity, there is no specific description of the range of the electric conductivity. In the first to seventh embodiments in JP 10-230608 A, there are only illustrated the ink guide the whole of which is covered with a conducting film except the attached substrate and the ink guide formed of a conductive member. This means that the ink guide is substantially made of a conductive material, which prevents the movement of the ink (i.e., charged colorant particles) to the guide tip end.

In the case where not all the ink guide is conductive but a part from the guide tip end to the midway of the ink guide is conductive, the ink (i.e., charged particles) moves easily to the upper end of the non-conductive portion of the ink guide, however, it becomes difficult for the ink to move further upward (i.e., to move into the lower end of the conductive portion) because of the reason mentioned above.

Therefore, there is a problem in that the ink is not ejected immediately after applying an ink ejection signal in any case, which causes delay in ejection of the ink.

In JP 11-268276 A, the ink guide is made of a single material such as a low dielectric constant material like insulating resin (e.g., polyimide) or a high dielectric constant material like ceramic.

Therefore, in the case of using the high dielectric constant material as the material of the ink guide for improving the ink ejection property, there is an advantage in that electric field strength can be increased at the guide tip end part serving as the ink ejection point, however, the ink becomes difficult to move to the guide tip end part because the electric field applied to the ink is not directed to the guide tip end. Thus, as described above, there occurs a problem in that ink ejection response to the ink ejection signal is delayed.

In the case where the ink guide is formed of a single low dielectric constant material, the ink moves to the guide tip end easily in comparison with the case of forming the ink guide from the high dielectric constant material, however, the control voltage needs to be increased in order to ensure sufficient electric field strength at the guide tip end part that is the ink droplet ejection point, which is not preferable in terms of system efficiency of the whole ink jet head.

In JP 2003-175612 A, the ejection part 232 that is the tip end part of the ink guide 230 shown in FIG. 18 is made thin in comparison with the support part 234, and the sharpened extreme tip end portion 236 of the ejection part 232 is made of a conducting material which has a high dielectric constant of 7 or higher, so that it is possible to obtain sufficiently high electric field strength for the extreme tip end portion 236 to serve as the ink droplet ejection point. However, the meniscus of the ink needs to be held only by the extreme tip end portion 236 of the ejection part 232 having a high dielectric constant in the ink guide 230, which is not sufficient in terms of more stable holding of a favorable meniscus and stable supply of the ink to the guide tip end in the case where higher ejection frequency responsivity is required, and the ink droplets need to be ejected at high ejection frequency.

A first object of the present invention is to solve the above problems of the conventional techniques, and to provide an electrostatic ink jet head in which ink moves easily to the tip end of the ink guide by efficiently controlling the electric fields exerted on the ink (i.e., charged particles) to achieve superior meniscus stability and to allow the meniscus to be maintained at a high position, thus stably ejecting the ink droplets and improving ejection responsivity of the ink jet head.

Further, a second object of the present invention is to solve the above problems of the conventional techniques, and to provide an image recording apparatus which comprises the ink jet head described above and is capable of stably forming an image with high resolution.

The inventors have made intensive researches about the ink guide structure of an electrostatic ink jet head in order to achieve the above first and second objects and achieved the present invention based on the following findings.

First, as described above, in order to move the ink (i.e., charged particles) up to the guide tip end part of the ink guide of the electrostatic ink jet head, it is required to form a favorable meniscus so that the tip end part is wetted with the ink solution. A pressure required for the liquid to be raised up to the tip end part having a pointed tip end is inversely proportional to the radius of curvature of the tip end, as expressed by the formula (1) given below.

$$P=2\cdot\gamma/R \quad (1)$$

In the formula (1), P is the pressure (Pa) required to maintain the meniscus, γ is the surface tension (N/m) of the ink solution for forming the meniscus, and R is the radius of curvature (m) of the meniscus.

It can be seen from the formula (1) that as the radius of curvature or the thickness of the tip end part of the ink guide is reduced, the pressure to form the meniscus is required to be increased. However, there is a limitation on the pressure applied to increase the height of the meniscus.

Accordingly, in order to solve the above problem, a predetermined step capable of holding the ink solution at the tip end part of the ink guide needs to be provided so as to fix the ink meniscus.

On the other hand, in order to improve the ejection responsivity of the electrostatic ink jet head, it is required to a) facilitate the movement of the ink including the charged particles to the tip end of the ink guide which serves as the ink ejection point, and b) have high electric field strength at the guide tip end part of the ink guide at the time of inputting the ejection signal.

The above conditions need to be satisfied to improve the ejection responsivity of the head, however, the conventional head structures have difficulty in satisfying the above all conditions. For example, the ink guide in which the whole surface thereof is coated with the conductive material (e.g., by metal evaporation) such as the one disclosed in JP 10-230608 A, and the ink guide which is formed of the high dielectric constant material (e.g., ceramic) such as the one disclosed in JP 11-268276 A, can have increased electric field strength, so that the above-described condition b) can be satisfied. However, regarding the movement of the ink (i.e., charged particles) to the guide tip end, the electric field applied to the ink (i.e., charged particles) is not directed toward the guide tip end but is directed outward, which makes the movement of the ink (i.e., charged particles) to the guide tip end difficult. Therefore, the above-described condition a) cannot be satisfied. Consequently, it has been difficult to improve the ejection capability of the head as a whole.

Accordingly, it is required to a) facilitate the movement of the ink (i.e., charged particles) to the guide tip end, and b) efficiently acquire electric field strength necessary for ejection of the ink droplets from the guide tip end part.

For facilitating the movement of the ink (i.e., charged particles) to the guide tip end, it is desirable that the electric field applied to the ink (i.e., charged particles) be directed toward the guide tip end part along the side walls of the ink guide.

For efficiently acquiring electric field strength necessary for ejection of the ink droplets from the guide tip end part, when forming the electric field necessary for ejecting the ink (i.e., charged particles) having reached the guide tip end as droplets, it is desirable that the drive voltage for acquiring the electric field strength sufficient for ink ejection (that is, the difference between $V_{on}$ and $V_{off}$, where $V_{on}$ is the voltage of the ejection electrode at the time of ejection, and $V_{off}$ is the voltage of the ejection electrode at the time of non-ejection) be lower in view of the efficiency for forming the electric field.

Further, in order to ensure the ejection capability of the ink jet head, it is required to set a condition on the conductive region in the ink guide, especially, in the guide tip end part thereof.

That is, in order to achieve the first object of the present invention, a first aspect of the present invention provides an ink jet head that ejects ink droplets by exerting an electrostatic force on ink having dispersed charged particles, including:

an insulating ejection substrate in which through holes for ejecting the ink droplets are formed;

ejection electrodes, each being arranged in each of the through holes, respectively, and exerting the electrostatic force on the ink; and ink guides, each passing through each of the through holes, respectively, and protruding from an ink droplet ejection side of the insulating ejection substrate, wherein each of the ink guides includes a flat plate shaped support part and a flat plate shaped tip end part that extends from an end portion of the support part having a predetermined thickness and is directed toward the ink droplet ejection side, the tip end part is formed so that a back surface of the tip end part is flush with a back surface of the support part, and the tip end part is thinner than the support part to form a step on a front surface side and is gradually narrowed toward the ink droplet ejection side, and the electrostatic force exerted on the ink has at least a component directed toward a tip end of an ink guide along the tip end part.

Preferably, the ink guide includes a member having a dielectric constant distribution.

Further, preferably, the ink guide is formed of at least two kinds of materials with different dielectric constants.

Further, preferably, at least an extreme tip end (edge) region including an extreme tip end (edge) of the tip end part of the ink guide is formed of a material having a relatively higher dielectric constant than that of the other regions of the ink guide.

Further, preferably, a root region including a root of the support part of the ink guide is formed of a material having a relatively higher dielectric constant than that of the other regions of the ink guide.

Further, preferably, an extreme tip end region including an extreme tip end of the tip end part and a root region of the support part in the ink guide are formed of a material having a relatively higher dielectric constant than that of other regions of the ink guide.

Further, preferably, an extreme tip end region including an extreme tip end of the tip end part of the ink guide is a high dielectric constant region that has a relatively higher dielectric constant than that of the other regions of the ink guide, and is approximately equal to or smaller in size than the ink droplets ejected from the tip end part.

Further, preferably, the tip end of the support part from which the tip end part of the ink guide extends and at which the step is formed has a shape approximately similar to the tip end shape.

Further, preferably, a tip of the tip end part of the ink guide has a radius of curvature of 2 μm or more.

Further, preferably, a difference in thickness between the support part and the tip end part is 20 μm or more.

Further, preferably, a cutout portion extending in a droplet ejecting direction is formed in the tip end of the support part from which the tip end part of the ink guide extends and at which the step is formed, so that the tip end is formed into a comb shape having at least one tooth portion.

Further, preferably, the at least one tooth portion of the tip end of the support part formed into the comb shape protrudes on the droplet ejection side with respect to the end of the tip end of the support.

In order to achieve the second object of the present invention, a second aspect of the present invention provides an image recording apparatus including:

an ink jet head that ejects ink droplets by exerting an electrostatic force on ink having dispersed charged particles, including:

an insulating ejection substrate in which through holes for ejecting the ink droplets are formed;

ejection electrodes, each being arranged in each of the through holes, respectively, and exerting the electrostatic force on the ink; and ink guides, each passing through each of the through holes, respectively, and protruding from an ink droplet ejection side of the insulating ejection substrate, wherein each of the ink guides includes a flat plate shaped support part and a flat plate shaped tip end part that extends from an end portion of the support part having a predetermined thickness and is directed toward the ink droplet ejection side, the tip end part is formed so that a back surface of the tip end part is flush with a back surface of the support part, and the tip end part is thinner than the support part to form a step on a front surface side and is gradually narrowed toward the ink droplet ejection side, the electrostatic force exerted on the ink has at least a component directed toward a tip end of an ink guide along the tip end part, and an image according to an image data is recorded on a recording medium.

According to the first aspect of the present invention, the step at the thin plate-shaped tip end part provided at a predetermined position in the ink guide can function as a fixing position for a meniscus, so the meniscus of the ink can be formed and held at a high position at the time of non-ejection of the ink. Further, the electrostatic force exerted on the ink at least has a component directed toward the tip end along the tip end part of the ink guide, that is, the ink guide has a dielectric constant distribution (i.e., relative dielectric constant distribution), and more preferably, the guide extreme tip end is formed of a material having a relatively high dielectric constant, so that the ink (i.e., charged particles) can move to the guide tip end easily. Accordingly, the ink can reach the tip end part of the ink guide, the time required to deform the liquid surface of the meniscus at the time of ejection of the ink can be shortened, and the electric field strength in the guide tip end part of the ink guide at the time of inputting the ejection signal can be increased (i.e., made higher), whereby it is possible to improve the efficiency for applying electric field to the ink, and efficiently ensure the electric field strength necessary for ejecting the ink droplets from the guide tip end part.

Consequently, according to this aspect, the ejection responsivity of the ink jet head can be improved.

Since the fixing point of the meniscus formed by the step is a stable point that will not move once fixed, this fixing point also functions as a fixing position at which a new meniscus is fixed. Thus, because of the step, the meniscus formed by the ink can be held at a high position of the ink guide without considering the tip end shape of the ink guide, and the pressure to the ink. Accordingly, it is possible to form the meniscus having a shape similar to the tip end shape of the tip end part of the ink guide.

Further, according to this aspect, since the meniscus can be formed based on the tip end shape of the tip end part of the ink guide, the shape of the meniscus does not fluctuate by the influence of the disturbances such as vibrations. Thus, the meniscus formed can be stabilized.

According to the second aspect of the present invention, since the ink guide of the first aspect having the above-described effects is used, the ink can be supplied to the ink guide smoothly, and the ejection frequency responsivity can be improved, thereby making it possible to stably eject the ink droplets even at high ejection frequency. Thus, in accordance with this aspect, an image with high resolution can be stably recorded at high speed.

BRIEF DESCRIPTION OF THE DRAWINGS

In the accompanying drawings:

FIG. 3A is a schematic perspective view showing one embodiment of an ink guide of the ink jet head shown in FIG. 2;

FIGS. 3B to 3D are respectively a schematic front view, a schematic side view, and a schematic top view of the ink guide shown in FIG. 3A;

FIG. 4 is an explanatory view explaining a movement of ink along a guide wall surface by means of electrostatic force exerted on the ink guide used in the present invention;

FIGS. 5A to 5C are respectively a schematic front view, a schematic side view, and a schematic top view showing another embodiment of the ink guide used in the present invention;

FIGS. 8A to 8C are respectively a schematic front view, a schematic side view, and a schematic top view showing still yet another embodiment of the ink guide used in the present invention;

FIGS. 9A' to 9E' are top views schematically showing the one example of the manufacturing process of the ink guide used in the present invention;

FIG. 9E" is a bottom view schematically showing the one example of the manufacturing process of the ink guide used in the present invention;

FIGS. 10A' to 10F' are top views schematically showing the another example of the manufacturing process of the ink guide used in the present invention;

FIGS. 11A' to 11E' are top views schematically showing the still another example of the manufacturing process of the ink guide used in the present invention;

FIGS. 12F' to 12I' are top views respectively corresponding to FIGS. 12F to 12I;

FIG. 16A is a schematic plan view showing a conventional ink guide;

FIG. 16B is a schematic side view of FIG. 16A;

FIG. 17 is a conceptual diagram for explanation of an example of the conventional ink jet head; and FIG. 18 is a partial perspective view of a conventional ink guide.

DETAILED DESCRIPTION OF THE PREFERRED EMBODIMENTS

Hereinafter, an ink jet head and an image recording apparatus including the ink jet head according to the present invention will be described in detail based on preferred embodiments illustrated in the accompanying drawings.

Figure 1:
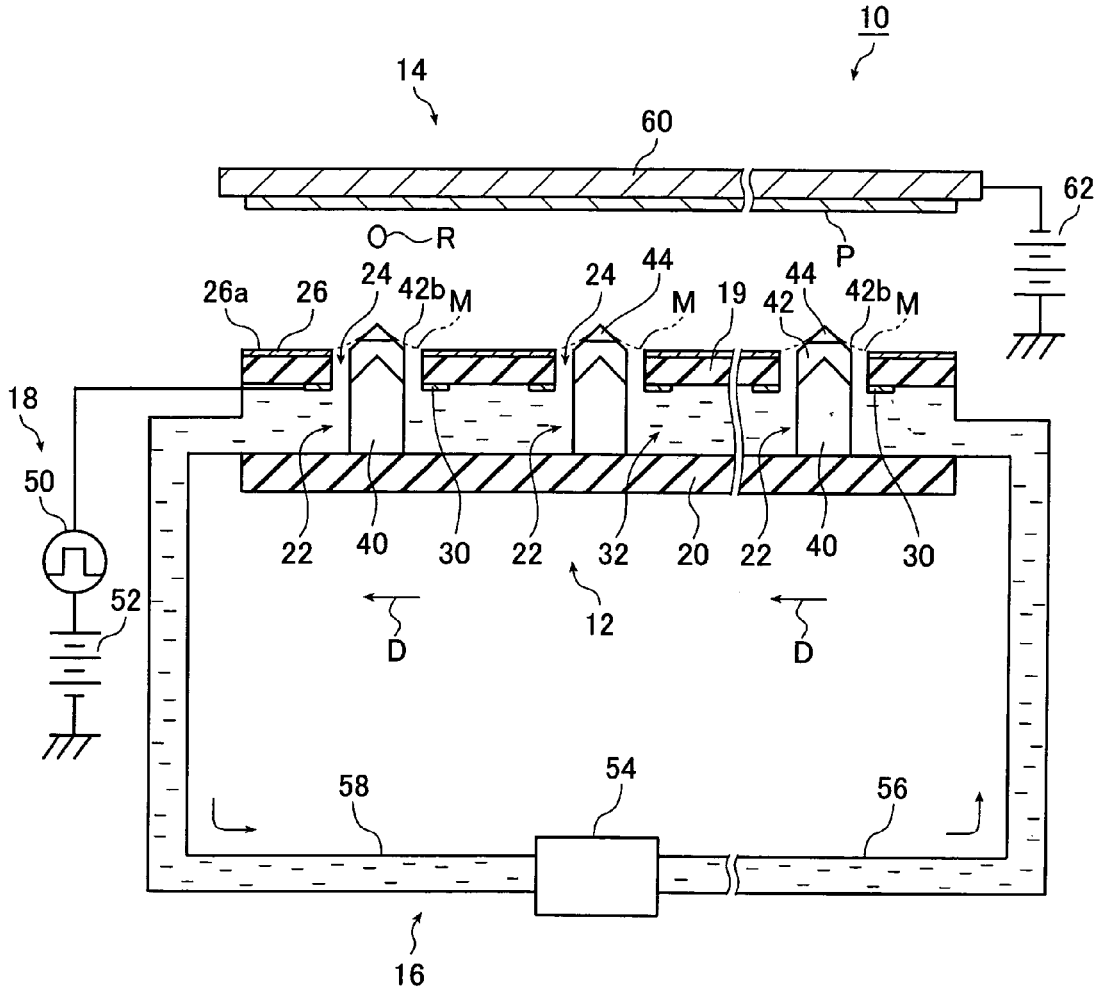
FIG. 1 is a schematic cross-sectional view showing one embodiment of an image recording apparatus using an ink jet head according to the present invention.
Figure 2:
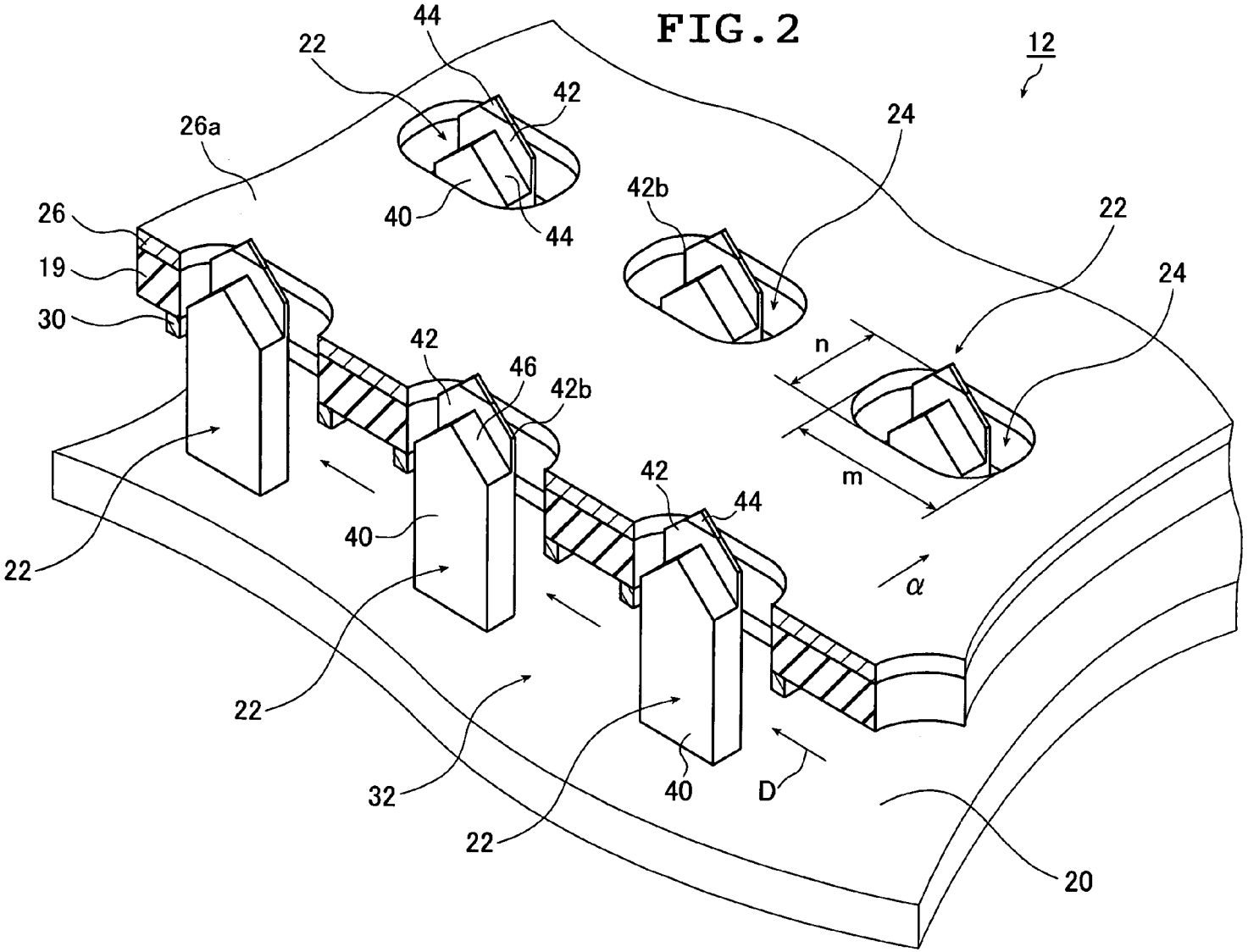
FIG. 2 is a schematic perspective view showing a main portion of one embodiment of the ink jet head shown in FIG. 1.

FIG. 1 is a schematic cross-sectional view showing one embodiment of the image recording apparatus according to the second aspect of the present invention including the ink jet head according to the first aspect of the present invention, and FIG. 2 is a schematic perspective view showing a main portion of one embodiment of the ink jet head shown in FIG. 1.

FIG. 3A is a schematic perspective view showing one embodiment (i.e., first embodiment) of an ink guide of the ink jet head shown in FIG. 2, and FIGS. 3B to 3D are a schematic front view, a schematic side view, and a schematic top view of the ink guide shown in FIG. 3A, respectively.

An image recording apparatus 10 shown in FIGS. 1 and 2 is an electrostatic ink jet recording apparatus which performs image recording (i.e., drawing) on a recording medium P by ejecting ink droplets R by means of electrostatic force. The image recording apparatus 10 basically comprises an ink jet head 12, holding means 14 for holding the recording medium P, an ink circulation system 16, and voltage application means 18.

As shown in FIGS. 1 and 2, the ink jet head 12 is, for instance, a so-called line head including lines of ejection ports 24 (hereinafter referred to as the "nozzle lines") for ejecting the ink droplets R whose length corresponds to the length of one side of the recording medium P.

In the image recording apparatus 10, in the state where the recording medium P is held by the holding means 14, and the recording medium P is regulated at a predetermined recording position while facing the ink jet head 12, the holding means 14 is moved (i.e., transported for scanning) in a direction orthogonal to the nozzle lines of the ink jet head 12, thereby allowing two-dimensional scanning of the entire surface of the recording medium P with the nozzle lines. In synchronization with the scanning, the ink droplets R are ejected from each ejection port 24 of the ink jet head 12 through modulation in accordance with an image to be recorded, thereby allowing drop-on-demand recording of the image on the recording medium P.

At the time of the image recording, the ink Q is circulated by the ink circulation system 16 through a predetermined circulation path including the ink jet head 12 (i.e., ink flow path 32 to be described later) and is supplied to each ejection port 24.

The ink jet head 12 is an electrostatic ink jet head that ejects the ink Q as the ink droplets R by means of electrostatic force.

The ink jet head 12 basically comprises an ejection substrate 19, a support substrate 20, and ink guides 22 as shown in FIGS. 1 and 2.

The ejection substrate 19 is a substrate made of a ceramic material such as $Al_2O_3$ or $ZrO_2$, or an insulating material such as polyimide, and many ejection ports 24 for ejecting the ink droplets R of the ink Q are formed so that they penetrate the ejection substrate 19.

As shown in FIG. 2, as a preferable example in which higher-resolution and higher-speed image recording is possible, the ink jet head 12 comprises the ejection ports 24 arranged in a two-dimensional lattice.

It should be noted here that the ink jet head of the present invention is not limited to the structure shown in FIG. 2, in which the ejection ports 24 are arranged in a lattice, and may have a structure in which adjacent nozzle lines are displaced from each other by a half pitch in the nozzle line direction so that the ejection ports are arranged in a staggered manner, for instance. Alternatively, the ink jet head of the present invention may have a structure in which the ejection ports are not arranged in a two-dimensional manner but only one nozzle line is included.

The present invention is not limited to the line head shown in FIG. 1 and FIG. 2 and may be applied to a so-called shuttle-type ink jet head that performs drawing by transporting the recording medium P intermittently by a predetermined length corresponding to the length of the nozzle line and moving the ink jet head in a direction orthogonal to the nozzle line in synchronization with the intermittent transportation.

Further, the ink jet head of the present invention may be an ink jet head that ejects only one kind of ink corresponding to monochrome image recording or an ink jet head that ejects several kinds of inks corresponding to color image recording.

The region except the ejection ports 24 on the surface of the ejection substrate 19 from which droplets are ejected, that is, the surface on the recording medium P side (hereinafter, referred to as an upper surface, and the opposite side thereof will be referred to as a lower surface) is covered with a shield electrode 26 entirely.

The shield electrode 26 is a sheet-shaped electrode made of a conductive metallic plate or the like and common to every ejection port 24. The shield electrode 26 is held at a predetermined potential (including 0 V when grounded). With the shield electrode 26, it becomes possible to suppress electric field interference between adjacent ejection ports 24 (i.e., ejection portions) by shielding against electric lines of force between the ejection portions, so that the ink droplets R can be stably ejected. As necessary, the surface of the shield electrode 26 may be subjected to ink repellent treatment.

For the lower surface of the ejection substrate 19, ejection electrodes 30 are provided to the respective ejection ports 24. The ejection electrodes 30 are, for example, each a ring-shaped electrode surrounding the ejection port 24, and are connected to the voltage application means 18.

The voltage application means 18 is connected to ejection electrodes 30. The voltage application means 18 is a unit in which a drive voltage source 50 and a bias voltage source 52 are connected to each other in series, with a pole (positive pole, for instance) having the same polarity as that of the potential of the charged colorant particles of the ink Q being connected to the ejection electrodes 30 and the other pole being grounded.

The drive voltage source 50 is, for instance, a pulse voltage source and supplies pulse-shaped drive voltages modulated in accordance with an image to be recorded (i.e., image data, or ejection signal) to the ejection electrodes 30. The bias voltage source 52 constantly applies a predetermined bias voltage to the ejection electrodes 30 during image recording. With the bias voltage source 52 (that is, through the bias voltage application by the bias voltage source 52), it becomes possible to achieve a reduction in drive voltage, which makes it possible to achieve a reduction in voltage consumption and a cost reduction of the drive voltage source.

It should be noted that the ejection electrode 30 is not limited to the ring-shaped electrode surrounding the ejection port 24 and may be a rectangle-shaped electrode surrounding the ejection port 24. In addition, the ejection electrode 30 is not limited to the electrode surrounding the entire region of the ejection port 24 and an ejection electrode having an approximately C shape or the like is also usable.

In this embodiment, preferably, the ejection electrode 30 has such a shape in which a part thereof on the upstream side in an ink flow direction D is removed. With this construction, no electric field that inhibits inflow of colorant particles into the ejection ports from the upstream side in the ink flow direction D is formed, so it becomes possible to supply the colorant particles to the ejection ports 24 with efficiency. Also, a part of the ejection electrode 30 exists on the ink downstream side, so that electric fields are formed in such a direction that colorant particles having flowed into the ejection ports 24 are retained at the ejection ports 24. As a result, by forming the ejection electrodes 30 into a shape in which a part thereof on the upstream side in the ink flow direction D is removed, it becomes possible to further enhance the capability of supplying particles to the ejection ports 24.

The support substrate 20 is a substrate formed by using an insulating material such as glass.

The ejection substrate 19 and the support substrate 20 are arranged so that they are spaced apart from each other by a predetermined distance, i.e., the lower surface of the ejection substrate 19 and the upper surface of the support substrate 20 are spaced apart from each other by a predetermined distance while facing each other, and a gap therebetween serves as the ink flow path 32 for supplying the ink Q to each ejection port 24.

The ink flow path 32 is connected to the ink circulation system 16 to be described later and as a result of circulation of the ink Q through a predetermined path by the ink circulation system 16, the ink Q flows through the ink flow path 32 in the ink flow direction D (in the example illustrated in FIG. 1, from the right to the left, for instance) and is supplied to each ejection port 24.

The ink guides 22 are provided on the upper surface of the support substrate 20.

The ink guides 22 constitute a characteristic part of the present invention, and are arranged to the respective ejection ports 24. Each ink guide 22 includes the protruding tip end part, and extends through the ejection port 24 so as to protrude from the surface of the ejection substrate 19 toward the recording medium P side (i.e., holding means 14 side). The ink guide 22 is formed such that the electrostatic force exerted on the ink Q at least has a component directed toward the tip end along the tip end part, and facilitates the ejection of the ink droplets R by guiding the ink Q supplied from the ink flow path 32 to a corresponding ejection port 24 to the tip end part so as to form a meniscus, stabilizing the meniscus through adjustment of the shape and size of the meniscus, and concentrating an electric field (or electrostatic force) on the meniscus through concentration of the electric field on the tip end part.

Each set of one ejection port 24, one ejection electrode 30, and one ink guide 22 corresponding to one another forms one ejection portion corresponding to one dot droplet ejection.

The ink guide 22 is required to be able to facilitate the movement of the ink Q to the tip end part so as to suitably guide the ink Q and appropriately stabilize the meniscus of the ink Q at the ejection port 24 (that is, superior in the meniscus stability), and to be able to suitably concentrate the electrostatic force (that is, favorable electric field concentrating capability) so as to ensure the electric field strength sufficient for ink ejection. In order to achieve such abilities, it is important that the ink guide 22 be molded with high precision in a shape in which reliable and favorable guiding of the ink is possible even when the ink guide 22 is minute, and the electrostatic force exerted on the ink Q at least has a component directed toward the tip end along the protruding tip end part. Preferably, the ink guide 22 is formed of a member having a dielectric constant distribution (i.e., relative dielectric constant distribution). For example, it is important that the ink guide be processed such that the region of the extreme tip end portion of the ink flow path protruding tip end part has a high dielectric constant in comparison with other regions.

The ink guides 22 constitute a characteristic part of the present invention. For instance, as shown in FIGS. 2 and 3A to 3D, the ink guide 22 includes a flat-plate-shaped support part 40 and a flat-plate-shaped tip end part 42 that extends from the support part 40 with back surfaces of the support part 40 and the tip end part 42 flush with each other thus forming a back surface 22*a* of the ink guide 22 so that the ink guide 22 has a stepped shape on the front surface side. The extreme tip end region or the edge region of the extreme tip end of the tip end part 42 is a high dielectric constant region 44 which is formed of a material having a relative dielectric constant different from that of the other regions (i.e., remaining regions of the tip end part 42 and the support part 40). The high dielectric constant region 44 is formed of, for example, a material having a higher dielectric constant. The thickness of the tip end part 42 is set to be thinner than the support part 40, so a step is formed at a joint portion between the support part 40 and the tip end part 42. The ink guides 22 are arranged on the upper surface of the support substrate 20 so that the tip end parts 42 are directed toward a droplet ejection side (i.e., recording medium P side).

As shown in FIGS. 3A and 3B, the tip end part 42 of the ink guide 22 has such a protruding tip end shape that the width of the tip end part 42 (i.e., width of a surface 42*e* of the tip end part 42) gradually decreases. More specifically, the tip end part 42 is such that side surfaces 42*a* on both sides in a width direction of the tip end part 42 extend, and a pair of inclined surfaces 42*c* respectively connected to the side surfaces 42*a* at shoulder portions 42*b* incline and gradually get closer to each other toward the ink ejection direction to be connected at a top 42*d*.

In the illustrated example, the tip end shape of the tip end part 42 is an approximately right triangle with its approximately right-angled vertex at the top 42*d* in the front view. Thus, the shape of the high dielectric constant region 44 of the extreme tip end is also an approximately right triangle.

As shown in FIGS. 3B and 3C, the top 42*d* of the tip end part 42 of the ink guide 22 has a predetermined curvature in either of the front view and the side view. It is preferable that a radius of curvature of the top 42*d* be small for sharpening in either of the front view and the side view. However, when the radius of curvature of the top 42*d* is too small, additional pressure is required to raise the position of the meniscus, so there is a lower limit to the radius of curvature of the top 42*d*. Therefore, in either of the front view and the side view, the lower limit of the radius of curvature of the top 42*d* is preferably 2 μm or more, more preferably 6 μm or more.

In the front view, the upper limit of the radius of curvature of the top 42*d* in either of the front view and the side view is a half of the width of the tip end part 42. In this case, the tip end part 42 is formed in a semicircular shape in the front view. On the other hand, in the side view, the upper limit of the radius of curvature of the top 42*d* is a half of the width of the inclined surface 42*c*. In this case, the tip end part 42 is also formed in a semicircular shape.

The tip end part 42 of the ink guide 22 is provided with the high dielectric constant region 44 at the extreme tip end thereof. The high dielectric constant region 44 is formed of the high dielectric constant material having a high dielectric constant in comparison with the other regions of the ink guide 22, i.e., the remaining regions of the tip end part 42 and the support part 40. The whole high dielectric constant region 44 may be formed of the high dielectric constant material. Alternatively, the ink guide 22 including the tip end part 42 may be formed of the low dielectric constant material, and the high dielectric constant region 44 may be provided by forming a coating made from the high dielectric constant material only on the appropriate portion of the edge region at the extreme tip end. The high dielectric constant region 44 includes the top 42*d* of the ink guide 22, however, the structure may be such that the region where the top 42*d* is formed includes the high dielectric constant region 44.

The size of the high dielectric constant region 44 is not specifically limited so long as the electrostatic force exerted on the ink Q at least has a component directed toward the top 42*d* of the tip end part 42 or an edge 46*b* of a step portion 46 along the inclined surfaces 42*c* of the tip end part 42 or the inclined surfaces 46*a* of the step portion 46. The high dielectric constant region 44 may be a part of the top 42*d* of the tip end part 42, or the whole tip end part 42. Alternatively, the high dielectric constant region 44 may include the edge 46*b* of the step portion 46.

The high dielectric constant region 44 is preferably formed of, for example, a material having a relative dielectric constant $\in$ of 7 or more. Examples of the high dielectric constant material include an organic material such as PVDF (polyvinylidene fluoride; dielectric constant $\in$ is 10), and an organic-inorganic composite material in which inorganic high dielectric constant microparticles are dispersed in an organic material having a low dielectric constant such as the one (dielectric constant $\in$ is 40) in which 40 wt % of lead magnesium niobate-lead titanate (PMN-PT; dielectric constant $\in$ is 17,800) is dispersed in epoxy resin, ceramic materials such as zirconia and PZT, and a semiconducting material such as silicon (dielectric constant $\in$ is 12). A metallic material such as aluminum (dielectric constant $\in$ is infinite) can be selected as the high dielectric constant material, so that the high dielectric constant region 44 may be a film formed by metal evaporation. However, in this case, consideration should be given to the fact that the wettability of the high dielectric constant region 44 with respect to the ink is deteriorated, which would make the ink supply to the tip end part unstable.

The regions other than the high dielectric constant region 44, that is, the regions of the ink guide 22 other than the extreme tip end region of the tip end part 42 are preferably formed of a low dielectric constant material, for example, a material having a relative dielectric constant $\in$ of less than 7, more preferably 4 or less. Examples of such low dielectric constant material include an insulating resin material such as polyimide (dielectric constant $\in$ is 3.5), and $SiO_2$ (dielectric constant $\in$ is 4.5) which is formed by oxidation of silicon. In view of sharpening of the top 42*d* of the tip end part 42 and the edge 46*b* of the step portion 46 of the support part 40 in the ink guide 22, reducing the thickness of the tip end part 42, and formability of the step portion 46 or the like, the insulating resin material such as polyimide is preferable.

Although described later, upon forming the tip end part 42 and the step portion 46 of the ink guide 22, and the high dielectric constant region 44, for example, various manufacturing methods used in a semiconductor manufacturing process such as a photolithographic method, or a laser beam machining method may be used.

In the present invention, in order that the ink guide 22 has a dielectric constant distribution so as to have an electrostatic force component along the tip end part 42 of the ink guide 22, there needs to be a difference in the relative dielectric constant ∈ between the high dielectric constant material for forming the high dielectric constant region 44 of the ink guide 22 and the low dielectric constant material for forming the regions other than the high dielectric constant region 44.

The difference in the relative dielectric constant ∈ between the high dielectric constant material for forming the high dielectric constant region 44 of the ink guide 22 and the low dielectric constant material for forming the regions other than the high dielectric constant region 44 is preferably 3 or more. More preferably, the relative dielectric constant ∈ of the high dielectric constant material for forming the high dielectric constant region 44 is 7 or more, the relative dielectric constant ∈ of the low dielectric constant material for forming the regions other than the high dielectric constant region 44 is less than 7, and the difference in the relative dielectric constant ∈ between both materials is 3 or more.

The difference in the relative dielectric constant ∈ is established between the material for forming the extreme tip end region of the tip end part 42 of the ink guide 22 and the material for forming the regions other than the extreme tip end region, so that the component of the electrostatic force directed toward the tip end of the ink guide 22 can work efficiently. Consequently, the present invention can be realized not only by forming the tip end part (or the extreme tip end region) from the high dielectric constant material but also by forming the substrate (or the regions other than the extreme tip end region) from the high dielectric constant material.

The step portion 46 is formed at the tip end of the support part 40 on the tip end part 42 side to have a shape approximately similar to the tip end shape of the tip end part 42 as shown in FIG. 3B. The step portion 46 has a protruding tip end shape. More specifically, a pair of inclined surfaces 46*a* that are respectively connected to side surfaces 40*a* at shoulder portions 40*b* on both sides of the support part 40 in a widthwise direction extend at the same angles as the inclined surfaces 42*c* of the tip end part 42 and gradually get closer to each other to be connected at the edge 46*b*. As shown in FIG. 3C, the edge 46*b* is formed perpendicularly to the surface 42*e* of the tip end part 42.

Next, the meniscus formed by the ink guide 22 will be described.

In the ink guide 22 of the illustrated example, as shown in FIG. 3C, the edge 46*b* of the step portion 46 functions as a pinning point F (i.e., fixing position) of a meniscus $M_1$ formed from an ink liquid surface. The pinning point F is determined based on the shape of the step portion 46 and is a stable point that will not move once fixed. Further, the pinning point F also functions as a pinning point that fixes a new meniscus $M_2$. Also, the ink guide 22 has the high dielectric constant region 44 formed in the tip end part 42 as described later. Therefore, the meniscus $M_2$ is formed at a higher position. As a result, it becomes possible to make the ink Q reach the top 42*d* of the tip end part 42. In addition, a meniscus $M_3$ having approximately the same shape as the top 42*d* of the tip end part 42 is also formed.

As shown in FIG. 4, in the case where the tip end portion of the ink meniscus M formed at the ink guide 22 receives the electrostatic force Et (Etotal), the charged particles in the ink receive the electrostatic force to cause the ink to move toward the tip end of the ink guide 22 (i.e., the ink moves upward to wet the tip end of the ink guide 22). The ratio of an electrostatic force component Ei in the direction along the wall surface of the ink guide 22 is preferably large (ideally, Ei/Et is 1) in terms of efficiency. The dielectric constant of the ink guide 22 greatly contributes to the electrostatic force component Ei, so in the present invention, the electrostatic force component Ei can be controlled, for example, as follows: like the ink guide 22 shown in FIG. 4, the high dielectric constant region 44 is provided at the tip end of the tip end part 42, whereby the member of the ink guide 22 can have a dielectric constant distribution so as to direct the electric lines of force at each part on the surface of the ink guide 22 shown by the chain double-dashed lines in FIG. 4 to the guide tip end. Consequently, the ink can be efficiently moved to the top 42*d* of the tip end part 42 that serves as the ink ejection point, so that it is possible to improve the ink ejection responsivity of the ink jet head 12.

On the other hand, in the case of a conventional flat-plate-shaped ink guide 250 shown in FIGS. 16A and 16B obtained by forming a tip end part 252 in a triangle shape, an ink liquid surface is raised by giving hydrostatic pressure to the ink to form a meniscus M. In this case, however, no pinning point exists, so the meniscus M is obtained only by the ink hydrostatic pressure at the ejection port. Even in the case of the conventional ink guide 250, it is possible to raise the position of the meniscus M to the tip end part 252 by increasing the ink hydrostatic pressure. When doing so, however, it is required to excessively increase the ink hydrostatic pressure, so the sharpness of the meniscus shape is lowered and ejection of minute ink droplets becomes difficult. Consequently, it becomes impossible to reduce the sizes of dots obtained. When the ink pressure is increased too much, there arises a danger that the meniscus may collapse.

It is preferable that the ink guide 22 be arranged so that the shoulder portions 42*b* of the tip end part 42 protrude from the surface of the ejection port 24 (i.e., surface 26*a* of the guard electrode 26). With this construction, the effect that the position of the meniscus is raised by the step portion 46 (i.e., step) of the ink guide 22 is easily achieved, which makes it possible to maintain the meniscus M at a higher position.

Further, it is preferable that the edge 46*b* of the step portion 46 be above the shoulder portions 42*b* in a vertical direction. With this construction, it becomes possible to raise the meniscus M to a higher position. However, even when the edge 46*b* of the step portion 46 exists below the shoulder portions 42*b*, it is possible to achieve the effect of raising the meniscus M to a high position.

When consideration is given to electric field concentration at the tip end of the ink guide 22, that is, at the tip end portion of the meniscus, it is preferable that the ink guide 22 be formed so that at least its upper portion is gradually narrowed toward the tip end. The size of the meniscus is reduced by sharpening the tip end part of the ink guide in this manner, so it becomes possible to improve the ink droplet ejection property and reduce the size of the ink droplets R.

It should be noted that the overall height of the ink guide 22 is 580 μm and the overall width W of the ink guide 22 (i.e., width of the support part 40) is 210 μm, for instance. The tip end angle of the tip end part 42 formed by the pair of inclined surfaces 42*c* is 90°. The thickness $t_1$ of the support part 40 is 50 μm, and the thickness $t_2$ of the tip end part 42 is 13 μm. Further, a tip end portion length L that is a distance between the edge 46*b* of the step portion 46 and the top 42*d* of the tip end part 42 is 100 μm. Still further, the height H of the high dielectric constant region 44, that is, the length between the lower end of the high dielectric constant region 44 and the top 42*d* of the tip end part 42 is, for example, 20 μm.

Further, in the ink guide 22, the difference between the thickness $t_1$ of the support part 40 and the thickness $t_2$ of the tip end part 42 (that is, the step at the step portion 46) is preferably 20 μm or more. When the step at the step portion 46 of the ink guide 22 is less than 20 μm, the meniscus pinning effect is reduced.

As shown in FIG. 2, each ejection port 24 has a cocoon shape that is elongated in the ink flow direction and is obtained by forming both short sides of a rectangle in a semicircle shape. The aspect ratio (m/n) between a length m in the ink flow direction D and a length n in a direction α orthogonal to the ink flow direction D is 1 or more, for instance. The ink guide 22 is arranged so that its width direction coincides with the ink flow direction D in the ejection port 24.

In this embodiment, by setting the aspect ratio of the ejection port 24 at 1 or more, supply of the ink Q to the ejection port 24 is facilitated. That is, it becomes possible to enhance capability of supplying particles of the ink Q to the ejection port 24. As a result, the ink Q is supplied to the ejection port 24 sufficiently and smoothly, so ejection frequency responsivity of the ink droplets R is improved and occurrence of clogging of the ink Q is prevented.

In this embodiment, the ejection port 24 has an elongated cocoon shape but the present invention is not limited to this as long as the ink droplets R can be ejected from the ejection port 24. Therefore, it is possible to form the ejection port 24 in any shape such as an approximately circle shape, an oval shape, a rectangular shape, a rhomboid shape, or a parallelogram shape. For instance, the ejection port 24 may be formed in a rectangular shape, whose long sides extend in the ink flow direction D, or an oval shape or a rhomboid shape whose major axis extends in the ink flow direction. Further, the ejection port 24 may be formed in a trapezoidal shape with its upper base being on the upstream side in the ink flow direction, its lower base being on the downstream side in the ink flow direction, and its height in the ink flow direction being set longer than the lower base. In this case, it does not matter which one of the side on the upstream side and the side on the downstream side is set longer. Still further, the ejection port 24 may be formed in a shape in which a circle whose diameter is longer than the short side of a rectangle is connected to each short side of the rectangle whose long sides extend in the ink flow direction. Also, it does not matter whether the ejection port 24 has a shape, whose upstream side and downstream side are symmetric about a center thereof, or a shape whose upstream side and downstream side are asymmetric about a center thereof. For instance, the ejection port may be formed by setting at least one of an upstream-side end portion and a downstream-side end portion of a rectangular ejection port in a semicircle shape.

As described above, the ink is supplied by the ink circulation system 16 to the ink flow path 32 formed between the ejection substrate 19 and the support substrate 20.

The ink circulation system 16 comprises ink supply means 54 having an ink tank for reserving the ink Q and a pump for supplying the ink Q, an ink supply flow path 56 that connects the ink supply means 54 and an ink inflow opening of the ink flow path 32 (i.e., right-side end portion of the ink flow path 32 in FIG. 1) to each other, and an ink recovery flow path 58 that connects an ink outflow opening of the ink flow path 32 (i.e., left-side end portion of the ink flow path 32 in FIG. 1) and the ink supply means 54 to each other. In addition to these construction elements, the ink circulation system 16 may include ink replenishment means for replenishing the ink tank with the ink.

The ink Q is circulated through a path through which the ink Q is supplied from the ink supply means 54 to the ink flow path 32 of the ink jet head 12 through the ink supply flow path 56, flows through the ink flow path 32 in the ink flow direction D (i.e., from the right to the left in FIG. 1), and returns from the ink flow path 32 to the ink supply means 54 through the ink recovery flow path 58. During the ink circulation, the ink is supplied from the ink flow path 32 to each ejection port 24.

It should be noted that as the ink Q that the ink jet head 12 according to the present invention ejects, it is possible to use various kinds of ink Q (i.e., ink solutions) obtained by dispersing charged fine particles in a dispersion medium (e.g., ink Q obtained by dispersing charged particles containing colorants in a dispersion medium) and is applied to an electrostatic ink jet system. The details of the ink Q will be described later.

As described above, the holding means 14 holds the recording medium P and transports the recording medium P for scanning in a direction (hereinafter referred to as the "scanning direction") orthogonal to the nozzle line direction of the ink jet head 12.

The holding means 14 comprises a counter electrode 60 that also functions as a platen that holds the recording medium P in a state where the medium P faces the upper surface of the ink jet head 12 (or the ejection substrate 19), a counter bias voltage source 62 for applying a bias voltage to the counter electrode 60, and scanning and transporting means (not shown) for transporting the recording medium P in the scanning direction for scanning by moving the counter electrode 60 in the scanning direction. The recording medium P is transported and two-dimensionally scanned in its entirety by the ejection ports 24 (i.e., nozzle lines) of the ink jet head 12 and an image is thus recorded by the ink droplets R ejected from the respective ejection ports 24.

No specific limitation is imposed on the means for holding the recording medium P with the counter electrode 60 and any known method such as a method utilizing static electricity, a method using a jig, or a method by suction may be used.

Also, no specific limitation is imposed on a method of moving the counter electrode 60 and a known plate-shaped member moving method may be used. Note that in the image recording apparatus 10 using the ink jet head 12 according to the present invention, the recording medium P may be scanned by the nozzle lines by fixing the recording medium P and moving the ink jet head 12 for scanning.

The counter bias voltage source 62 applies a bias voltage having a polarity opposite to that of the ejection electrodes 30 and the charged colorant particles to the counter electrode 60. Note that the other pole side of the counter bias voltage source 62 is grounded.

Hereinafter, an image recording operation of the image recording apparatus 10 will be described.

At the time of image recording, the ink Q is circulated by the ink circulation system 16 through the path from the ink supply means 54 through the ink supply flow path 56, the ink flow path 32 of the ink jet head 12, and the ink recovery flow path 58 to the ink supply means 54 again. As a result of the circulation, the ink Q flows into the ink flow path 32 at a flow rate of, for example, 200 mm/second and is supplied to each ejection port 24.

Also, at the time of the image recording, the bias voltage source 52 applies a bias voltage of, for example, 100 V to the ejection electrodes 30. Further, the recording medium P is held by the counter electrode 60 and the counter bias voltage source 62 applies a bias voltage of, for example, −1000 V to the counter electrode 60. Accordingly, between the ejection electrodes 30 and the counter electrode 60 (or the recording medium P), a bias voltage of 1100 V is applied and electric fields (or electrostatic force) corresponding to the bias voltage are formed.

As a result of the circulation of the ink Q, the electrostatic force due to the bias voltage, the surface tension of the ink Q, the capillary action, the action of the ink guides 22, and the like (especially, the action of the high dielectric constant region 44 of the tip end part 42), meniscuses of the ink Q that reach the tip end parts 42 of the ink guides 22 are formed at the ejection ports 24. Then, the colorant particles (positively charged in this example) migrate to the ejection ports 24 (i.e., to the meniscuses at the tip end parts 42 of the ink guides 22) and the ink Q is concentrated. As a result of the concentration of the ink Q, the meniscuses further grow. Finally, a balance is struck between the surface tension of the ink Q and the electrostatic force or the like, and the meniscuses are placed in a stabilized state.

In this state, when the drive voltage source 50 applies drive voltages of, for example, 200 V to the ejection electrodes 30, the electrostatic force acting on the ink Q and the meniscuses is increased, and the concentration of the ink Q at the meniscuses is promoted. As a result, the meniscuses rapidly grow. Following this, when the growing force of the meniscuses, the moving force of the colorant particles to the meniscuses, and the attractive force from the counter electrode 60 exceed the surface tension of the ink Q, the ink Q whose colorant particles are concentrated is ejected as the ink droplets R.

The ejected ink droplets R move owing to momentum at the time of the ejection and the attractive force from the counter electrode 60, adheres to the recording medium P, and form an image.

As described above, at the time of the image recording, the recording medium P is transported in the scanning direction orthogonal to the nozzle lines to be scanned while facing the ink jet head 12.

Accordingly, a drive voltage modulated in accordance with image data (i.e., ink droplet R ejection signal) is applied to each ejection electrode 30 (that is, the ejection electrode 30 is driven) in synchronization with the transport of the recording medium P for scanning, to enable modulated ejection of the ink droplets R in accordance with an image to be recorded, thus performing drop-on-demand image recording onto the entire surface of the recording medium P.

As described above, the ink jet head 12 according to the present invention is provided with the ink guides 22 in each of which the step portion 46 of the support part 40 is formed into the shape similar to the tip end shape of the tip end part 42, and the high dielectric constant region 44 is formed at the tip end part 42, and the ink droplets R are ejected using the ink guides 22.

As described above, the edge 46*b* of the step portion 46 of the ink guide 22 functions as the pinning point F of the meniscus $M_1$ formed from the ink liquid surface. In addition, the pinning point F also functions as a pinning point that fixes the new meniscus $M_2$. Further, the high dielectric constant region 44 at the tip end part 42 serves to direct the electrostatic force exerted on the ink Q to the tip end of the ink guide 22. As a result, the meniscus $M_2$ is formed at a higher position. In the tip end part 42, the meniscus $M_3$ having approximately the same shape as the top 42*d* of the tip end part 42 is formed. It becomes possible to eject the ink droplets R in a state where the ink Q has reached the top 42*d* of the ink guide 22 in this manner.

The meniscus obtained by the ink guide 22 reflects the tip end shape of the tip end part 42 and the high dielectric constant of the high dielectric constant region 44, and is different from the meniscus obtained by the ink guide disclosed in JP 10-230608 A in which the tip end shape is determined by the ink. Therefore, even when disturbances such as vibrations are given, the shape of the meniscus obtained by the ink guide 22 of this embodiment will not change unlike the conventional case, so that the superior meniscus shape stability is achieved. Further, the meniscus obtained by the ink guide 22 reflects the tip end shape of the tip end part 42, so that it becomes possible to obtain the ink droplets R having a predetermined size corresponding to the tip end shape of the tip end part 42.

Therefore, in the image recording apparatus 10 including the ink jet head 12, the meniscus is held at a high position at each ejection port 24, so the ink Q is sufficiently supplied to the top 42*d*. As a result, even when the ink droplets R are ejected in succession at high speed, the ink Q is sufficiently supplied, which makes it possible to enhance the ejection frequency responsivity of the ink droplets R. As a result, it becomes possible to perform the image recording at high speed.

Further, superior meniscus shape stability is achieved, so it becomes possible to enhance the adhering position accuracy of the ink droplets R on the recording medium P and eject the ink droplets R of a predetermined size while suppressing variations in size. Therefore, it becomes possible to perform high-quality image recording. Still further, when color images are formed, it becomes possible to perform high-quality image recording while suppressing color drift.

In the ink jet head 12 of this embodiment, by providing the ink guide 22, it becomes possible to maintain the meniscus M at a high position of the ejection port 24 and it also becomes possible to stabilize the shape of the meniscus. Therefore, it becomes possible to enhance the ejection frequency responsivity of the ink droplets R and the adhering position accuracy of the ink droplets R and it also becomes possible to reduce variations in size of the ink droplet R. As described above, the ink jet head 12 of this embodiment has high performance in ejection of the ink droplets R.

In the ink jet head 12 of this embodiment, each ejection port 24 has an elongated cocoon shape that extends in the ink flow direction D, so the ink Q is sufficiently and smoothly supplied to the ejection port 24. As a result, the ejection frequency responsivity of the ink droplets R is further improved and, in addition, occurrence of clogging of the ejection port 24 by the ink Q is prevented.

Further, with the image recording apparatus 10 including the ink jet head 12 of this embodiment, it becomes possible to perform high-quality image recording at high speed.

In the ink guide 22 shown in FIGS. 3A to 3D, although the high dielectric constant region 44 is located in the approximately right triangular extreme tip end region at the tip end of the tip end part 42, the present invention is not limited thereto. The high dielectric constant region of any shape may be formed in the ink guide so long as at least the edge region at the extreme tip end of the tip end part of the ink guide is the high dielectric constant region, or so long as the constructional member of the ink guide has a relative dielectric constant distribution so that at least the electrostatic force exerted on the ink Q is directed toward the tip end along the tip end of the ink guide (e.g., so long as the high and low dielectric constant regions are formed in the constructional member of the ink guide).

An ink guide 23*a* shown in FIGS. 5A to 5C, an ink guide 23*b* shown in FIGS. 6A to 6C, an ink guide 23*c* shown in FIGS. 7A to 7C, and an ink guide 23*d* shown in FIGS. 8A to 8C to be explained below each has the same structure (i.e., same shape) as that of the ink guide 22 shown in FIGS. 3B to 3D except the high dielectric constant region, so that the same components are given the same reference numerals, and the explanations thereof are omitted here.

For example, like the ink guide 23*a* shown in FIGS. 5A to 5C, the regions of a predetermined width that includes the center plane of the tip end part 42 which passes through the top 42*d* of the tip end part 42 of the ink guide 23*a* and that extends to both sides of the center plane may be a high dielectric constant region 45*a*. The high dielectric constant region 45*a* is formed in the whole central region of the tip end part 42 that extends from the top 42*d* to the edge 46*b* of the step portion 46 and includes the extreme tip end region of the tip end part 42 of the ink guide 23*a*.

Figure 6C:
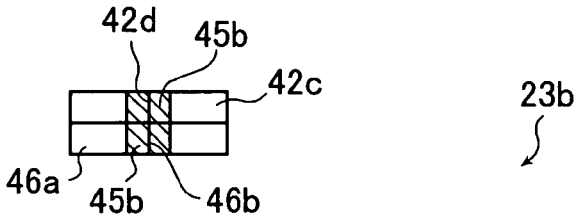
FIGS. 6A to 6C are respectively a schematic front view, a schematic side view, and a schematic top view showing still another embodiment of the ink guide used in the present invention.
Figure 6A:
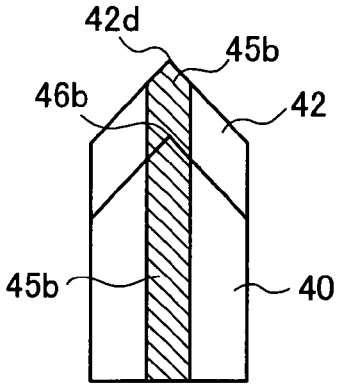
Figure 6B:
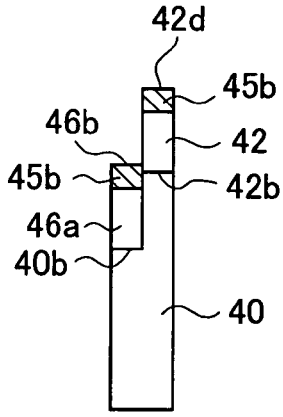

Also, like the ink guide 23*b* shown in FIGS. 6A to 6C, the regions of a predetermined width that include the center plane of the ink guide 23*b* which passes through the top 42*d* of the tip end part 42 and the edge 46*b* of the step portion 46 of the ink guide 23*b*, and that extend to both sides of the center plane may be a high dielectric constant region 45*b*. The high dielectric constant region 45*b* is formed in the whole central region of the ink guide 23*b* that extends from the top 42*d* of the tip end part 42 and the edge 46*b* of the step portion 46 to the end of the root region of the support part 40 and includes the extreme tip end region of the tip end part 42 of the ink guide 23*b*.

In any of the above-described ink guides 22, 23*a*, and 23*b* shown in FIGS. 3A to 3D, 5A to 5C, and 6A to 6C, at least the extreme tip end region of the tip end part 42 that is the ink ejection point is formed of the high dielectric constant material so as to serve as the high dielectric constant region 44, 45*a* or 45*b*, whereby the ink guide member has a distribution in dielectric constant so that the electrostatic force component Ei that is directed toward the guide tip end is increased with respect to the electrostatic force Et that the ink (or charged particles) receives.

At the protruding tip end of the ink guide, i.e., near the top 42*d* of the tip end part 42 of the ink guide 22, 23*a* or 23*b*, the size of the high dielectric constant region 44, 45*a*, or 45*b* is desirably approximately equal to the diameter of an ink droplet to be ejected (for example, about 10 μm in the width direction with the tip end as a center in the case where the diameter of an ink droplet is 10 μm). Setting the size of the high dielectric constant region larger than the above range substantially means that the whole ink guide is formed of the high dielectric constant material as a single material.

Accordingly, in the present invention, regarding the size of the high dielectric constant region formed of the high dielectric constant material, like the high dielectric constant region 44 of the ink guide 22 shown in FIGS. 3A to 3D, it is most desirable that only the lower portion of the high dielectric region 44 have approximately the same size as the diameter of the ink droplet to be ejected. For example, in the case where the high dielectric constant region extends downward in the ink guide as in the high dielectric constant region 45*a* of the ink guide 23*a* in FIGS. 5A to 5C and the high dielectric constant region 45*b* of the ink guide 23*b* in FIGS. 6A to 6C, the cross-sectional size of the high dielectric constant region 45*a* or 45*b* is set small, and the low dielectric constant region is provided on both sides thereof or surrounds the high dielectric constant region. Thus, it is prevented that the ink guide functions substantially the same as the ink guide which is entirely formed of the high dielectric constant material as a single material.

Figure 7C:
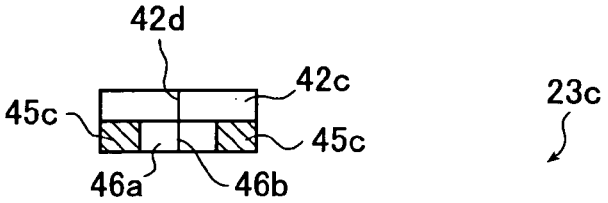
FIGS. 7A to 7C are respectively a schematic front view, a schematic side view, and a schematic top view showing yet another embodiment of the ink guide used in the present invention.
Figure 7A:
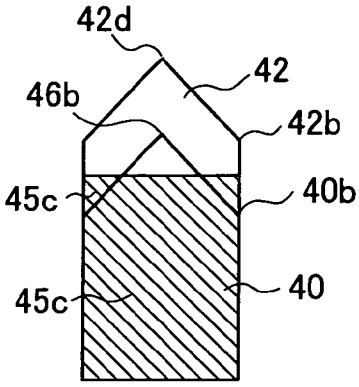
Figure 7B:
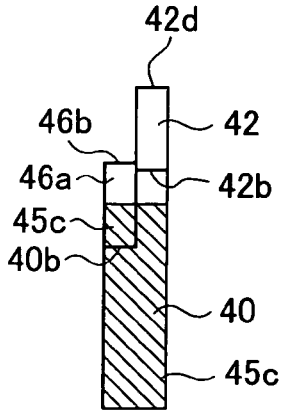

Further, like the ink guide 23*c* shown in FIGS. 7A to 7C, the root region on the support part 40 side of the ink guide 23*c* may be a high dielectric constant region 45*c*, and the tip end region on the top 42*d* side of the tip end part 42 may be formed of the low dielectric constant material. The high dielectric constant region 45*c* is the region below a predetermined border located between the line connecting the shoulder portions 40*b* of the support part 40 and the line connecting the shoulder portions 42*b* of the tip end part 42 in the ink guide 23*c* in the figures, that is, the root region on the support part 40 side. More specifically, the high dielectric constant region 45*c* includes the whole region of the support part 40 except the approximately triangular (i.e., triangular prism) region including the edge 46*b* of the step portion 46, and two approximately triangular (i.e., triangular prism) regions each having an apex at the shoulder portion 40*b* of the tip end part 42.

The high dielectric constant region 45*c* is formed by vapor-depositing a conductive metallic material onto the guide surface of the root region in the ink guide formed of the low dielectric constant material such as polyimide, whereby such ink guide 23*c* is formed. In such ink guide 23*c* having the dielectric constant distribution, the electrostatic force component Ei directed to the tip end of the ink guide is increased with respect to the electrostatic force Et in comparison with the ink guide which is not subjected to the metal evaporation and does not have the relative dielectric constant distribution. Therefore, the ink ejection responsivity of the ink jet head is improved.

Further, like the ink guide 23*d* shown in FIGS. 8A to 8C, both of the guide tip end region including the extreme tip end region of the tip end part 42 and the root region of the ink guide 23*d* may be a high dielectric constant region 45*d*. That is, the ink guide 23*d* is made by combining the two concepts of the ink guide 23*b* shown in FIGS. 6A to 6C and the ink guide 23*c* shown in FIGS. 7A to 7C.

The high dielectric constant region 45*d*, for example, includes the regions of a predetermined width that includes the center plane of the ink guide 23*d* which passes through the top 42*d* of the tip end part 42 and the edge 46*b* of the step portion 46 of the support part 40 and that extend to both sides of the center plane, and the region of the support part 40 below a predetermined border on the support part 40 in the figures, that is, the root region. That is, the high dielectric constant region 45*d* of the guide tip end region is formed in the central region of the tip end part 42 from the top 42*d* of the tip end part 42 to the root region of the ink guide 23*d* and the central region of the support part 40 from the edge 46*b* of the step portion 46 to the root region of the ink guide 23*d*, and the high dielectric constant region 45*d* of the root region is formed in the region of the support part 40 below the border connecting the both shoulder portions 40*b* of the support part 40 in the figures.

The ink guide used in the ink jet head of the present invention basically has the structure as described above.

Next, the ink guide manufacturing method of the ink guide used in the ink jet head of the present invention will be explained referring to FIGS. 9A to 14.

FIGS. 9A to 9E, 9A' to 9E', and 9E" schematically show cross-sectional views, top views, and a bottom view of one example of the manufacturing method of an ink guide 100, respectively. The ink guide 100 is similar in shape to the ink guide 22 shown in FIGS. 3A to 3D, and is similar in structure to the ink guide 23*d* shown in FIGS. 8A to 8C in which the high dielectric constant region includes the root region of the support part on the back surface side. The ink guide 100 may be used for one channel guide, or the ink guides 100 may be used for a one-dimensional multichannel guide in which a plurality of channels are aligned.

Figure 9A:
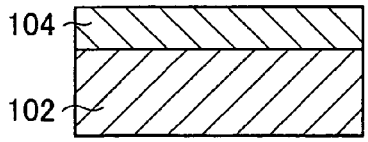
FIGS. 9A to 9E are cross-sectional views schematically showing one example of the manufacturing process of the ink guide used in the present invention.
Figure 9A:
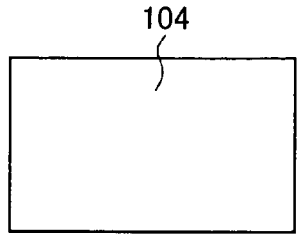

First, in the high dielectric constant layer forming process (a), as shown in FIGS. 9A and 9A', for example, a support substrate 102 with the thickness of 50 μm made of the low dielectric constant material such as polyimide (dielectric constant ∈ is 3.5) is covered with the high dielectric constant material to form a high dielectric constant layer 104 of 10 μm thickness. Examples of the high dielectric constant material include PVDF (dielectric constant ∈ is 10), and an organic-inorganic composite material in which inorganic high dielectric constant microparticles are dispersed in an organic material having a low dielectric constant such as one (dielectric constant ∈ is 40) in which 40 wt % of lead magnesium niobate-lead titanate (PMN-PT; dielectric constant ∈ is 17,800) is dispersed in epoxy resin. The material obtained by dispersing such high dielectric constant material in the solvent is applied by casting and spin coating, and is then dried, whereby the high dielectric constant layer 104 with the thickness of 10 μm is formed. Alternatively, a sheet-like high dielectric constant material with the thickness of 10 μm is bonded to the support substrate 102 by thermocompression bonding.

Figure 9B:
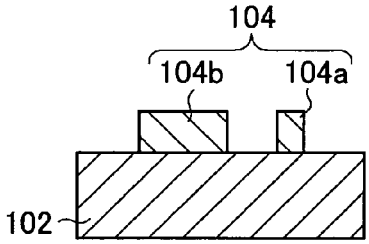
Figure 9B:
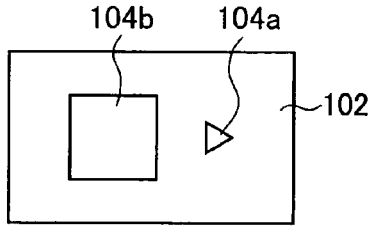

Next, in the high dielectric constant layer pattern forming process (b), as shown in FIGS. 9B and 9B', the high dielectric constant layer 104 is etched to leave only a triangular prism shaped guide edge region 104*a* and a quadrangular prism shaped root region 104*b* through the photolithographic etching, thereby forming the high dielectric constant layer pattern. That is, as shown in the cross-sectional view of FIG. 9B and the top plan view of FIG. 9B' corresponding to FIG. 9B, the high dielectric constant layer pattern is formed, in which only the guide edge region 104*a* and the root region 104*b* of the high dielectric constant layer 104 are left on the support substrate 102.

Figure 9C:
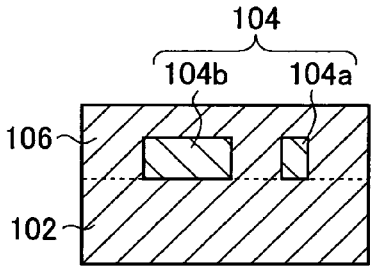
Figure 9C:
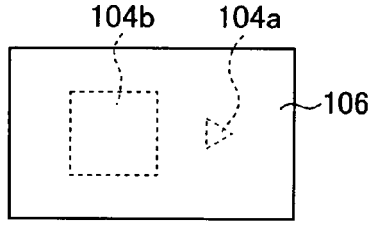

Next, in the low dielectric constant layer forming process (c), as shown in FIGS. 9C and 9C', a low dielectric constant layer 106 is formed over the high dielectric constant layer pattern (i.e., the guide edge region 104*a* and the root region 104*b*), in other words, the low dielectric constant layer 106 is formed on the surfaces of the support substrate 102, the guide edge region 104*a*, and the root region 104*b* to cover the high dielectric constant layer pattern so that the surface of the low dielectric constant layer 106 becomes flat. That is, the low dielectric constant layer 106 is formed with a thickness of, for example, 20 μm so that the surface of the low dielectric constant layer 106 becomes flat. At this time, the low dielectric constant material for forming the low dielectric constant layer 106 may be the same as or different from the material of the support substrate 102.

Figure 9D:
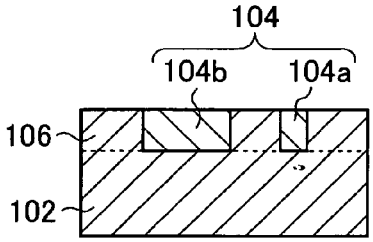
Figure 9D:
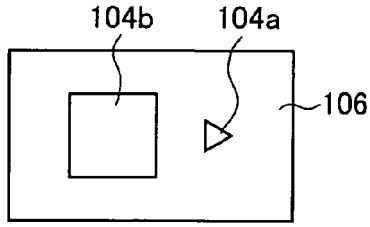

Next, in the flattening process (d), as shown in FIGS. 9D and 9D', the flat surface of the low dielectric constant layer 106 is etched to the extent that the surface of the high dielectric constant layer 104 (i.e., the guide edge region 104*a* and the root region 104*b*) is bared, and the surfaces of the high dielectric constant layer 104 and the low dielectric constant layer 106 are flattened.

Figure 9E:
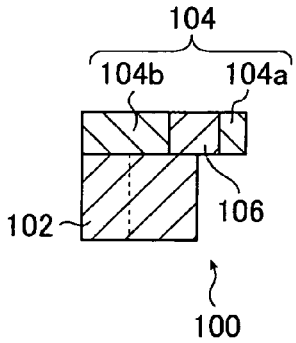
Figure 9E:
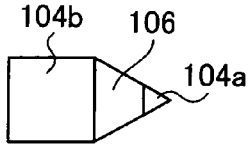
Figure 9E:
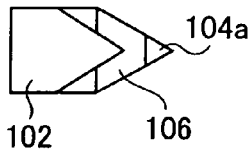

Finally, in the flattening process (e), as shown in FIGS. 9E, 9E', and 9E", the component processed above is formed into a final ink guide shape by the method such as laser processing or etching. As a result, the ink guide 100 can be manufactured, in which the protruding tip end part is formed, the edge region 104*a* is left as the high dielectric constant region, and the step portion is provided on the side of the lower dielectric constant support substrate 102 of the support part which is the root region. FIG. 9E' is a top view showing the front surface of the ink guide 100, and FIG. 9E" is a bottom view showing the back surface of the ink guide 100.

In the ink guide 100, both of the triangular prism shaped edge region 104*a* and the quadrangular prism shaped root region 104*b* are the high dielectric constant regions, so the ink guide 100 is, in this respect, similar in guide structure to the ink guide 23*d* shown in FIGS. 8A to 8C.

Next, another method of manufacturing the ink guides will be explained. FIGS. 10A to 10F and 10A' to 10F' schematically show front views, and top views of one example of the manufacturing method of an ink guide 110, respectively. The ink guide 110 is similar in guide structure to the ink guide 23*d* shown in FIGS. 8A to 8C. Although only one channel guide is shown in the figures, the ink guides 110 are used for a two-dimensional multichannel guide in which a plurality of channels are two-dimensionally arranged.

Figure 10A:
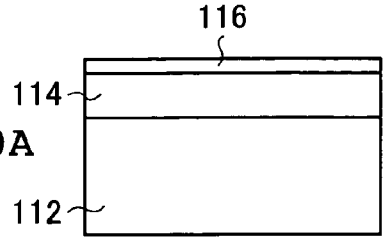
FIGS. 10A to 10F are front views schematically showing another example of the manufacturing process of the ink guide used in the present invention.
Figure 10A:
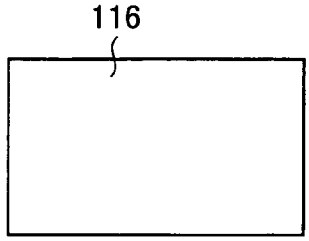

First, in the multilayered structure forming process (a), as shown in FIGS. 10A and 10A', the low dielectric constant material, for example, polyimide (dielectric constant ∈ is 3.5) or silicon dioxide ($SiO_2$; dielectric constant ∈ is 4.5) is laminated on the surface of a support substrate 112 made of the high dielectric constant material (e.g., silicon; dielectric constant ∈ is 12) to form a low dielectric constant layer 114 with the thickness of 100 μm, and the high dielectric constant material (e.g., the above-described organic-inorganic composite material in which inorganic high dielectric constant microparticles are dispersed in an organic material, and silicon) is further laminated thereon to form a high dielectric constant layer 116 with the thickness of 10 μm. Whereby, a multilayered structure is formed.

Figure 10B:
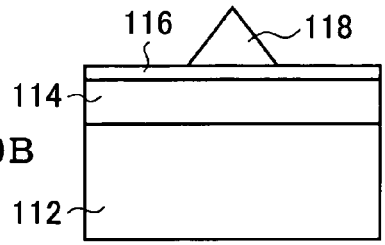
Figure 10B:
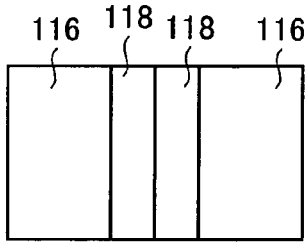

Following this, in the tip end mask forming process (b), as shown in FIGS. 10B and 10B', a three-dimensional shaped mask for forming the tip end part is formed. A mask 118 can be formed from the photoresist on the high dielectric constant layer 116 having a multilayered structure by using a grayscale mask or the like.

Figure 10C:
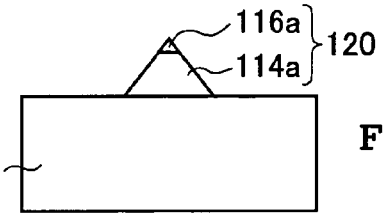
Figure 10C:
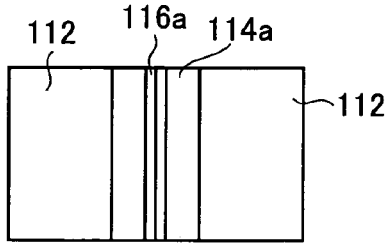

Next, in the first tip end etching process (c), as shown in FIGS. 10C and 10C', the high dielectric constant layer 116 and the low dielectric constant layer 114 are etched through dry etching by using the mask 118 so as to form a guide tip end part 120 with the thickness of, for example, 100 μm. Whereby, the guide tip end part (i.e., protrusion) 120 having a triangular cross section linearly extends to form a three-dimensional shape (i.e., triangular prism shape). The guide tip end part 120 comprises an edge region 116*a* having a triangular cross section (i.e., triangular prism shape) which is composed of the high dielectric constant layer 116 and is located at the top, and an intermediate region 114*a* having a trapezoidal cross section (i.e., trapezoidal prism shape) which is composed of the low dielectric constant layer 114 and is located under the edge region 116*a*.

Figure 10D:
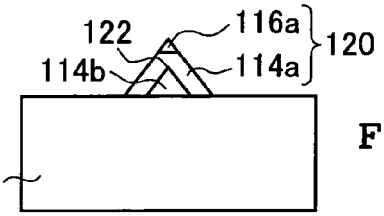
Figure 10D:
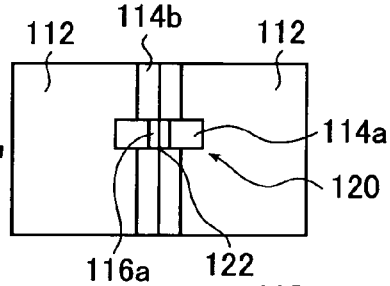

Next, in the second tip end etching process (d), as shown in FIGS. 10D and 10D', an aluminum mask with a predetermined width (for example, 10 μm) is formed as follows. That is, the surfaces of the guide tip end part 120 and the support substrate 112 are coated with a metallic film (e.g., aluminum film) to a thickness of 0.2 μm, and the metallic film is further coated with a resist by the spray coating method. Then, pattern formation is performed on the surface of the three-dimensional shaped guide tip end part 120 by the projection exposure apparatus, and the aluminum is etched, thereby forming an aluminum mask of a predetermined width (e.g., 10 μm). The aluminum mask formed in the above manner is used to etch a non-masked part of the guide tip end part 120 to a predetermined depth through dry etching or the like to thereby form the tip end having a triangular cross section (i.e., triangular prism shaped tip end). In other words, the non-masked part of the guide tip end part 120 is etched to remove the edge region 116*a*, and is etched while maintaining the triangular cross-sectional shape, whereby a tip end part 114*b* which is composed only of the low dielectric constant layer 114 and has a triangular cross section (i.e., triangular prism shape) is formed. Therefore, a step is formed in the guide tip end part 120. In this case, the etching depth is, for example, 50 μm, so the guide tip end part 120 having a triangular cross section is etched to a depth of 50 μm to form the tip end part 114*b* having a triangular cross section.

Thereafter, the aluminum mask is etched to be removed. The guide tip end part 120 which remains intact owing to the existence of the aluminum mask is 10 μm in width.

As in the illustrated example, the guide tip end part 120 having the edge region 116*a* formed of the high dielectric constant material at the tip end is etched in a state of being covered with the mask, and the tip end part 114*b* having a triangular cross section is formed, thereby forming an ink supply portion 122 at the tip end thereof.

Figure 10E:
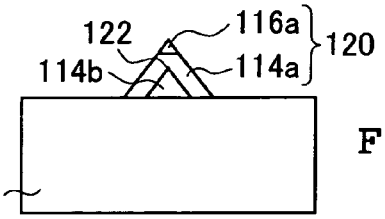
Figure 10E:
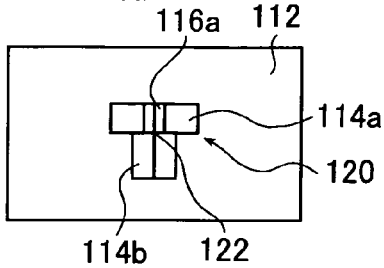

Next, in the third tip end etching process (e), as shown in FIGS. 10E and 10E', unnecessary portion is etched by the method similar to the above-described method, whereby a part of the tip end part 114*b* which is on one side of the guide tip end part 120 is removed except a portion having a predetermined width, and a part of the tip end part 114*b* which is on the other side of the guide tip end part 120 is all removed. Whereby, the guide tip end part that has a step and a guide width of, for example, 50 μm is formed.

Figure 10F:
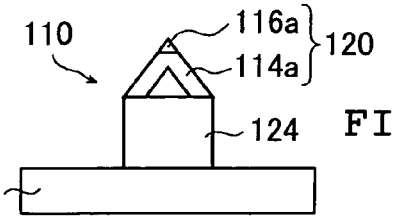
Figure 10F:
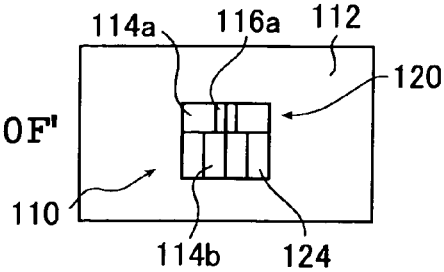

Finally, in the support part etching process (f), as shown in FIGS. 10F and 10F', the support substrate 112 is etched to a depth of 500 μm by the pattern forming method similar to the above-described method to form a quadrangular prism shaped support part 124, whereby the ink guide 110 is manufactured.

The plurality of ink guides 110 are connected at the lower parts thereof to the support substrate 112 having a predetermined thickness, so the two-dimensional multichannel guide in which a plurality of channels are two-dimensionally arranged is manufactured.

Figure 11A:
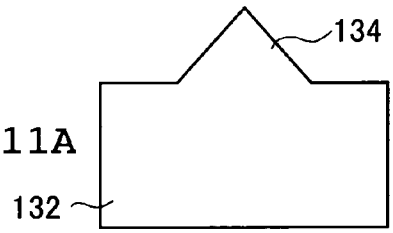
FIGS. 11A to 11E are front views schematically showing still another example of the manufacturing process of the ink guide used in the present invention.
Figure 11A:
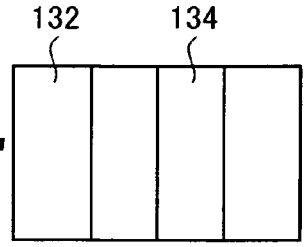
Figure 11B:
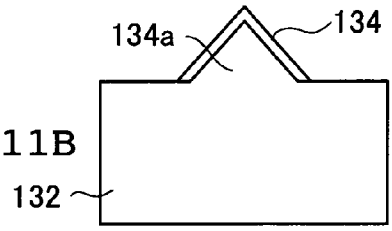
Figure 11B:
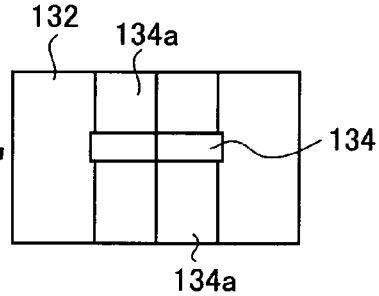
Figure 11C:
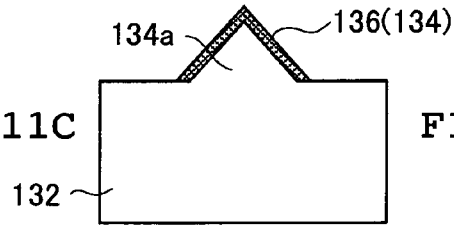
Figure 11C:
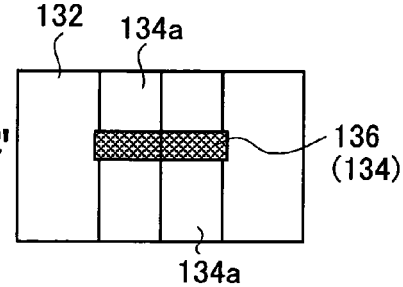
Figure 11D:
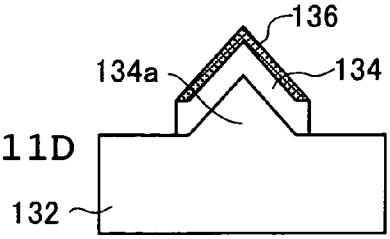
Figure 11D:
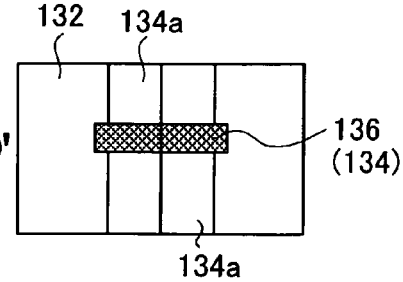
Figure 11E:
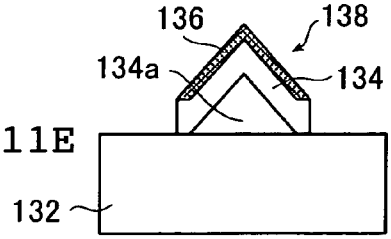
Figure 11E:
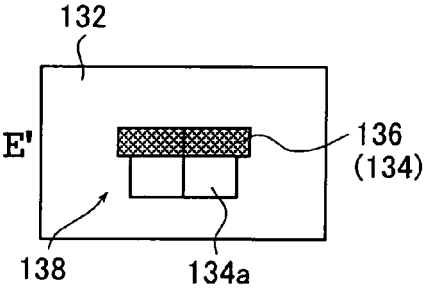
Figure 12F:
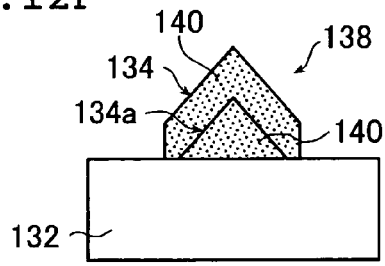
FIGS. 12F to 12I are front views schematically showing the process following the manufacturing process shown in FIGS. 11A to 11E.
Figure 12F:
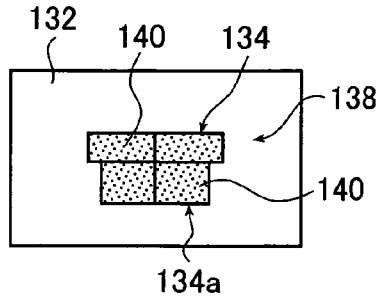

FIGS. 11A to 11E and FIGS. 12F to 12I, and 11A' to 11E' and FIGS. 12F' to 12I' are front views and top views schematically showing one example of a manufacturing method of an ink guide 130, respectively. The ink guide 130 has a guide structure approximately similar to that of the ink guide 22 shown in FIGS. 3A to 3D. Only one channel is shown in the figures, however, the ink guides 130 are used for the two-dimensional channel guide in which a plurality of channels are two-dimensionally arranged.

First, in the tip end part forming process (a), as shown in FIGS. 11A and 11A', in order to form the tip end part of the ink guide, a triangular cross section shaped (i.e., triangular prism shaped) guide tip end part (i.e., protrusion) 134 is formed on the surface of a support substrate 132 formed of the high dielectric constant material (e.g., silicon; ∈ is 12). As the method for forming the tip end part, it is possible to employ the method explained in the two-dimensional guide manufacturing method for manufacturing the ink guide 110 shown in FIGS. 10A to 10F', or dicing, an anisotropic etching using KOH, or the like.

Next, in the first tip end etching process (b), as shown in FIGS. 11B and 11B', the guide tip end part 134 is subjected to dry etching. The guide tip end part 134 is etched to a depth of, for example, 20 μm to leave the guide tip end part 134 with a predetermined width and a step is formed on each side thereof. Both sides of the remaining guide tip end part 134 are etched while maintaining the triangular cross-sectional shape, whereby a protruding low tip end part 134*a* is formed.

Next, in the first insulating layer coating process (c), as shown in FIGS. 11C and 11C', the first insulating layer such as an insulating layer 136 (e.g., formed of silicon nitride ($Si_3N_4$)) with the smallest possible thickness of 0.1 μm is formed on the guide tip end part 134, the tip end part 134*a*, and the support substrate 132 by plasma CVD or the like, and then the insulating layer 136 except that formed on the guide tip end part 134 is removed so that the insulating layer 136 remains only on the upper surface and the side surfaces of the guide tip end part 134.

Next, in the second tip end etching process (d), as shown in FIGS. 11D and 11D', dry etching is performed to a depth of, for example, 40 μm by using the insulating layer 136 as a mask. Thus, the tip end part 134*a* is further lowered with respect to the guide tip end part 134. The tip end part 134*a* and the support substrate 132 are etched while the tip end part 134*a* maintains the triangular cross section and the support substrate 132 keeps its surface flat. The guide tip end part 134 is, however, masked with the insulating layer 136, so that both ends of the guide tip end part 134 form approximately vertical side walls.

Next, in the third tip end etching process (e), as shown in FIGS. 11E and 1E', the guide tip end part 134 and the tip end part 134*a* of a predetermined width adjacent to the guide tip end part 134 are masked by using a mask material (e.g., aluminum (Al), nickel (Ni), or silicon dioxide ($SiO_2$)) that is different from the material of the insulating layer 136 ($Si_3N_4$), and the third tip end etching is performed, whereby the non-masked part of the tip end part 134*a* is removed and the tip end shape 138 having a step is obtained in the ink guide 130.

Next, in the second insulating layer coating process (f), as shown in FIGS. 12F and 12F', similarly to the above third tip end etching process (e), the surfaces of the support substrate 132 and the tip end shape 138 are coated with the mask material that is different from that of the insulating layer 136 ($Si_3N_4$) again. The mask material in the portion other than the surface of the tip end shape 138 is removed, so an insulating layer 140 is formed only on the tip end shape 138 so as to serve as a mask for etching the support part.

Figure 12G:
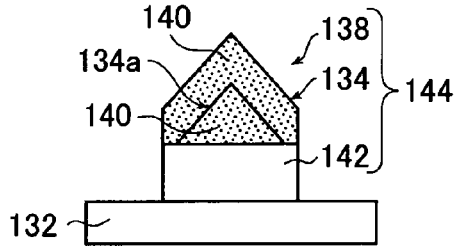
Figure 12G:
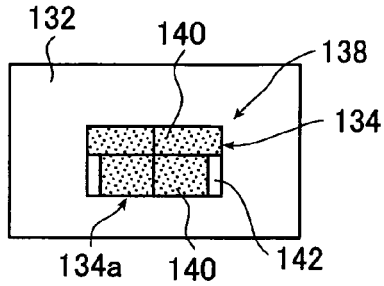

Next, in the support part etching process (g), as shown in FIGS. 12G and 12G', the support substrate 132 is etched by using the insulating layer 140 formed in the process (f) as the mask for etching the support part, whereby a support part 142 is formed under the tip end shape 138. At this time, the etching depth is, for example, 500 μm. Thus, a whole shape 144 of the ink guide 130 is formed.

Figure 12H:
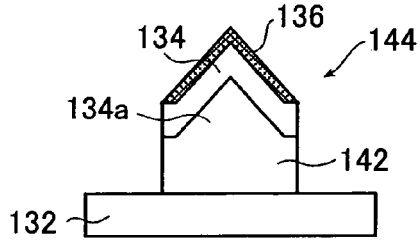
Figure 12H:
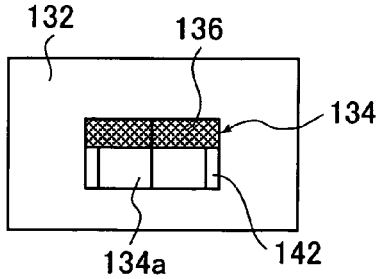

Thereafter, in the second insulating layer removing process (h), as shown in FIGS. 12H and 12H', the insulating layer 140 on the tip end shape 138 is removed, for example, by etching. At this time, the insulating layer 136 on the guide tip end part 134 remains intact without being etched.

Figure 12I:
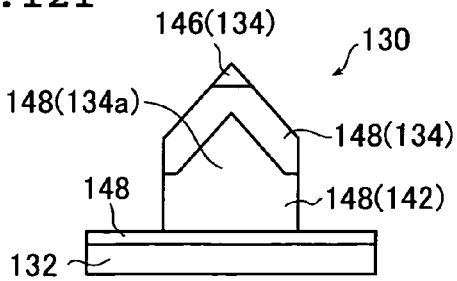
Figure 12I:
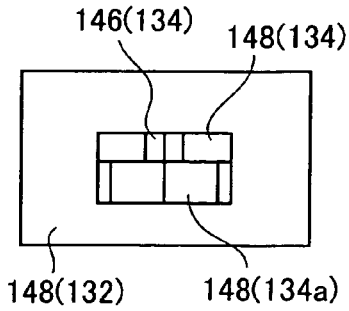

Finally, in the oxide film forming process (i), as shown in FIGS. 12I and 12I', the whole shape (formed of silicon) 144 of the ink guide 130 is oxidized, so that the portion except an edge region 146 of the guide tip end part 134, that is, the guide tip end part 134 except the edge region 146, the tip end part 134*a*, the support part 142, and the support substrate 132 have oxidized surface layers. The guide tip end part 134, the tip end part 134*a*, and the support part 142 of the whole shape 144, and the support substrate 132 are made from silicon, so that the surfaces except the edge region 146 which is covered with the insulating layer 136 are oxidized to form a silicon oxide film 148. The silicon oxide film 148 may be formed by thermal oxidation or anodic oxidation. The dielectric constant ∈ of $SiO_2$ formed by oxidation of silicon is 4.5, which is about ⅓ of the dielectric constant ∈ of silicon.

The silicon of the guide tip end portion 134 is difficult to oxidize due to silicon nitride ($Si_3N_4$) of the insulating layer 136 covering the guide tip end part 134, so that silicon remains at the edge region 146 of the guide tip end part 134 without being oxidized. In the case of performing thermal oxidation of the silicon, the inclined surface portion of the guide tip end part 134 having a thickness of 10 μm need only be oxidized from each side wall by at least 5 μm in order to reduce the dielectric constant of the inclined surface portion, and oxidization is achieved by heating at 1200° C. for 20 hours in a humidified atmosphere.

Then, the plurality of ink guides 130 each having the guide structure approximately similar to the ink guide 22 shown in FIGS. 3A to 3D are connected at the lower parts thereof to the support substrate 132 having a predetermined thickness, whereby the two-dimensional multichannel guide in which the channels are two-dimensionally arranged is manufactured. In this embodiment, the high dielectric constant material of the support substrate 132 may be aluminum ($\in=\infty$).

Figure 13A:
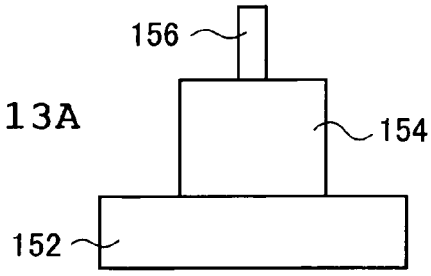
FIGS. 13A, 13A', and 13B are respectively a front view, a top view, and a front view schematically showing yet another example of the manufacturing process of the ink guide used in the present invention.
Figure 13A:
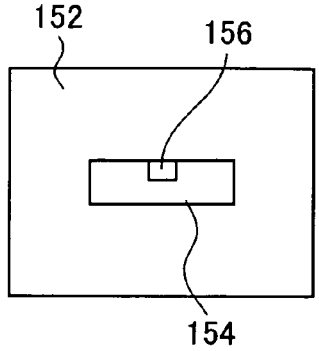

FIGS. 13A, 13A', and 13B are respectively a front view, a top view, and a front view schematically showing one example of a manufacturing method of an ink guide 150. The ink guide 150 is similar in structure to the ink guide 23*b* shown in FIGS. 6A to 6C. Although only one channel guide is shown in the figures, the ink guides 150 are used for a two-dimensional multichannel guide in which a plurality of channels are two-dimensionally arranged.

First, in the tip end part forming process (a), a member made of a high dielectric constant material (e.g., zirconia, PZT, and silicon) is processed to form the tip end part of the ink guide. As shown in FIGS. 13A and 13A', the member made of the high dielectric constant material is processed to form a support substrate 152, a rectangular parallelepiped support part 154 on the support substrate 152, and a quadrangular prism shaped tip end part 156 on the support part 154. For example, the quadrangular prism shaped tip end part 156 has a rectangle in horizontal cross section with a size of 10 μm×50 μm, and is 100 μm in depth, and the rectangular parallelepiped support part 154 under the tip end part 156 has a size of 50 μm×400 μm in horizontal cross section and a depth of 500 μm. This processing can be carried out by dry etching, laser beam machining, electric discharging, or the like.

Figure 13B:
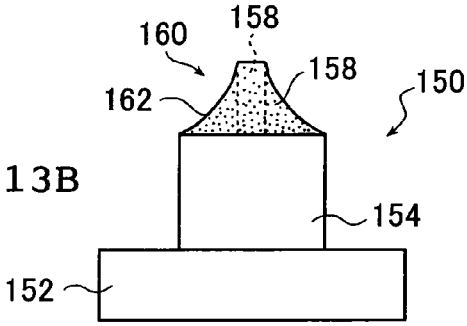

Next, in the low dielectric constant material applying process (b), as shown in FIG. 13B, the low dielectric constant material 158 is applied around the tip end part 156. For example, polyimide dispersed in the solvent is applied around the tip end part 156 by spin coating, spray coating, immersion coating, or the like, and an inclined surface portion 162 is formed on the upper surface of the tip end part 160 of the ink guide 150 through drying of the meniscus formed in the liquid state.

In this way, the plurality of ink guides 150 each having the guide structure approximately similar to that of the ink guide 23*d* shown in FIGS. 6A to 6C are connected at the lower parts thereof to that of the support substrate 152 having a predetermined thickness, whereby the two-dimensional multichannel guide in which the channels are two-dimensionally arranged is manufactured.

The above-described ink guide manufacturing methods refer to exemplary methods of manufacturing the ink guides 130, 150, 100, and 110 that are respectively similar in guide structure to the ink guide 22 in FIGS. 3A to 3D, the ink guide 23*b* in FIGS. 6A to 6C, the ink guide 23*d* in FIGS. 8A to 8C, and the ink guide 23*d* in FIGS. 8A to 8C. However, these are merely examples of the ink guide manufacturing method. In the present invention, the ink guide manufacturing method is not limited to the above-described examples, and the ink guides 23*a* and 23*c* shown in FIGS. 5A to 5C, and 7A to 7C, respectively may also be manufactured by the similar methods.

The above-described examples mainly refer to the case of using the ink guide in which the shape of the tip end part is approximately similar to that of the step portion between the tip end part and the support part (i.e., tip end shape of the support part), however, the present invention is not limited thereto. The shape of the tip end part may be different from that of the support part.

For example, as shown in FIGS. 14 and 15A to 15C, the ink guide may be such that the tip end of the support part is formed into a comb shape.

Figure 14:
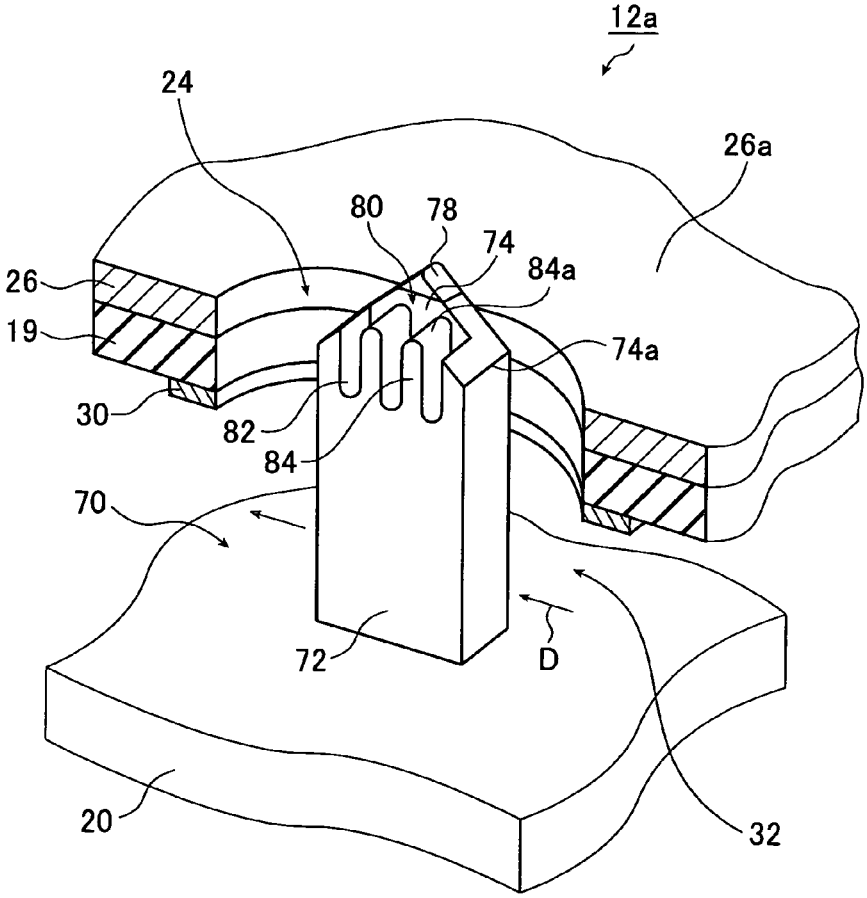
FIG. 14 is a schematic cross-sectional view showing another embodiment of the image recording apparatus using the ink jet head according to the present invention.
Figure 15A:
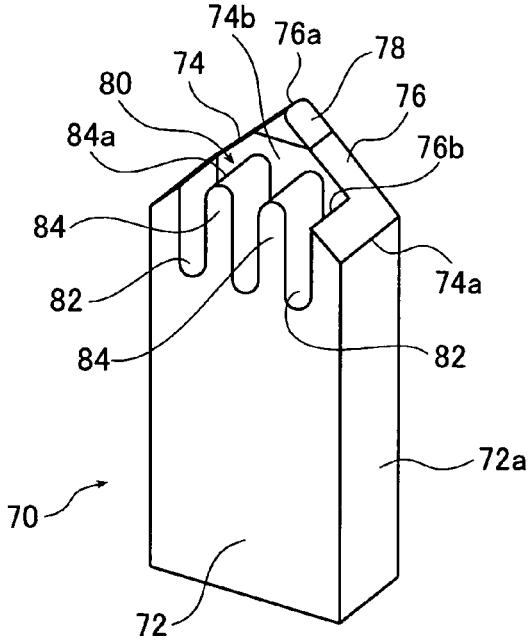
FIG. 15A is a schematic perspective view showing one embodiment of an ink guide of the ink jet head shown in FIG. 14.
Figure 15B:
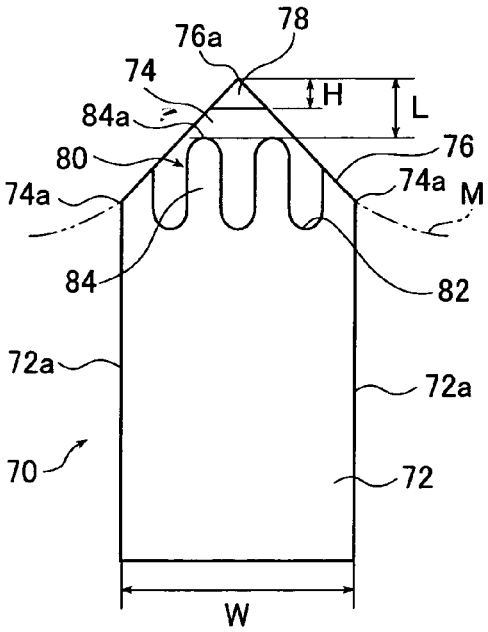
FIG. 15B and FIG. 15C are respectively a schematic front view and a schematic side view of the ink guide shown in FIG. 15A.
Figure 15C:
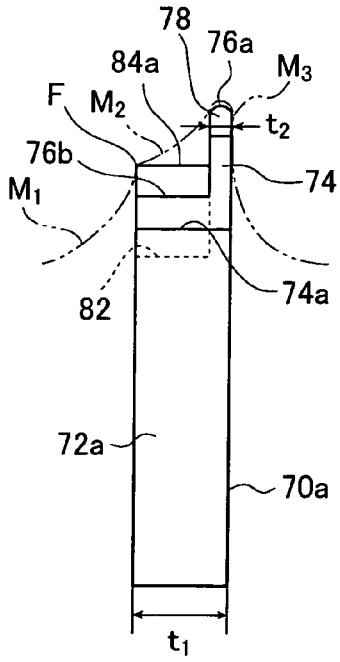

FIG. 14 is a schematic partial cross-sectional view showing a main portion of another embodiment of the ink jet head of the present invention. FIG. 15A is a schematic perspective view showing another embodiment (i.e., second embodiment) of the ink guide of the ink jet head shown in FIG. 14, FIG. 15B is a schematic front view of the ink guide shown in FIG. 15A, and FIG. 15C is a schematic side view of the ink guide shown in FIG. 15A.

An ink jet head 12*a* shown in FIG. 14 has the same structure as that of the ink jet head 12 shown in FIG. 2 except that an ink guide 70 is used instead of the ink guide 22, so that the same components are given the same reference numerals, and the detailed explanation thereof is omitted here.

As shown in FIGS. 14 and 15A to 15C, the ink guide 70 includes a flat-plate-shaped support part 72 and a tip end part 74 that extends from the support part 72, and back surfaces of the support part 72 and the tip end part 74 are flush with each other to form a back surface 70*a* of the ink guide 70. The support part 72 and the tip end part 74 form a step on the front surface side thereof. The extreme tip end region or the edge region of the tip end part 74 serves as a high dielectric constant region 78 which is formed of a material having a relative dielectric constant different from that of the other regions, i.e., the other regions of the tip end part 74 and the support part 72. For example, the high dielectric constant region 78 is formed of a high dielectric constant material. The ink guide 70 is formed such that the tip end portion (i.e., step portion) 80 of the support part 72 is processed into a comb shape. The tip end shape of the tip end part 74 of the ink guide 70 is the same as that of the tip end part 42 of the ink guide 22 shown in FIGS. 3A to 3D, and the structures of the high dielectric constant region 78 and the support part 72 of the ink guide 70 are the same as those of the high dielectric constant region 44 and the support part 40 of the ink guide 22 shown in FIGS. 3A to 3D, respectively. Thus, the detailed explanations thereof are omitted here.

In the step portion 80 at the tip end of the support part, for example, three cutout portions 82 extending in a direction in which the tip end part 74 extends are formed at predetermined intervals in the width direction of the support part 72. The three cutout portions 82 are formed, so that two tooth portions 84 are formed. Edges 84*a* of the tooth portions 84 on the tip end part 74 side are each formed by a curved surface having a predetermined curvature. The edges 84*a* of the tooth portions 84 exist on the upper side with respect to shoulder portions 76*b* of the tip end part 74, for instance. By having the edges 84*a* of the tooth portions 84 with the curved surfaces in this manner, it becomes possible to prevent strong unnecessary electric fields from being generated in proximity to the ejection portions, which makes it possible to stabilize the ink ejection property.

The ink guide 70 is formed to have the comb shaped step portion 80, so that the cutout portions 82 play a role of an ink reservoir and a role of capillaries. Accordingly, it becomes possible to supply the ink Q to the tip end part 74 of the ink guide 70. Therefore, it is preferable that a distance between the edges 84*a* of the tooth portions 84 and a top 76*a* of the tip end part 74 be short.

The edges 84*a* of the tooth portions 84 function as meniscus pinning points, like the edge 46*b* of the ink guide 22 shown in FIG. 3A. Therefore, it is preferable that the edges 84*a* of the tooth portions 84 exist on the upper side with respect to the surface of the ejection port 24 (i.e., surface 26*a* of the guard electrode 26). In addition, there are many cases where the shoulder portions 76*b* of the tip end part 74 of the ink guide 70 are arranged on the upper side with respect to the surface of the ejection port 24, so it is preferable that the edges 84*a* of the tooth portions 84 exist on the upper side with respect to the shoulder portions 76*b* of the tip end part 74 for instance.

Further, the step portion 80 of the ink guide 70 is formed in the comb shape, so that the tooth portions 84 play a role of a member for reinforcing the tip end part 74. Therefore, it becomes possible to increase the mechanical strength of the ink guide 70, in particular, the tip end part 74. The ink guide 70 is an extremely small member and the tip end part 74 is extremely thin, so it is effective that the mechanical strength of the tip end part 74 is increased.

Still further, when the edges 84*a* of the tooth portions 84 are provided on the upper side with respect to the shoulder portions 76*b* of the tip end part 74, for instance, a distance between the tip end part 74 and the edges 84*a* is shortened, therefore the mechanical strength is increased.

By forming the step portion 80 of the ink guide 70 in the comb shape in the manner described above, it becomes possible to facilitate supply of the ink Q and it also becomes possible to increase the mechanical strength.

It should be noted that the overall height of the ink guide 70 is 580 μm and the overall width W of the ink guide 70 (i.e., width of the support part 72) is 210 μm, for instance. The tip end angle of the tip end part 74 formed by a pair of inclined surfaces 76 is 90°, the radius of curvature of the tip end part 74 is 6 μm in either direction of the front view and the side view, the thickness $t_1$ of the support part 72 is 50 μm, and the thickness $t_2$ of the tip end part 74 is 13 μm. Further, a tip end part length L that is a distance between the edges 84*a* of the step portion 80 and the top 76*a* of the tip end part 74 is 50 μm. Still further, a height H of the high dielectric constant region 78, i.e., the length between the lower end of the high dielectric constant region 78 and the top 76*a* of the tip end part 74 is, for example, 20 μm, the width of the tooth portion 84 is 30 μm, and the radius of curvature of the edge 84*a* of the tooth portion 84 is 15 μm.

Even in the case of the ink guide 70, like in the embodiment shown in FIGS. 3A to 3D, it is preferable that a difference between the thickness $t_1$ of the support part 72 and the thickness $t_2$ of the tip end part 74 (i.e., step between the support part 72 and the tip end part 74) be 20 μm or more. When the ink guide 70 does not have the difference (i.e., step) of 20 μm or more, the meniscus pinning effect is reduced.

It should be noted that the ink guide 70 has the three cutout portions 82 but the present invention is not limited to this, and at least one cutout portion 82 will suffice.

It is possible to produce the ink guide 70 by an ink guide manufacturing method that is the same as that for producing the ink guide 22 shown in FIGS. 3A to 3D.

In the ink jet head 12*a*, the ink guide 70 is provided for each ejection port 24 and a meniscus is formed at each ejection port 24. The meniscus formed by the ink guide 70 will be described.

Even in this embodiment, like the embodiment shown in FIGS. 3A to 3D, the edges 84*a* of the step portion 80 function as pinning points F of a meniscus $M_1$ as shown in FIG. 15C. The pinning points F are determined based on the comb shape of the step portion 80 and are stable points that will not move once fixed. Further, the pinning points F also function as pinning points for fixing a new meniscus $M_2$. In addition to this, the ink guide 70 has the high dielectric constant region 78 at the tip end part 74. Therefore, the meniscus $M_2$ is formed at a higher position. In this way, it becomes possible to make the ink Q reach the top 76*a* of the tip end part 74. In addition, a meniscus $M_3$ having approximately the same shape as the top 76*a* of the tip end part 74 is also formed at the tip end part 74.

The step portion 80 of the ink guide 70 of this embodiment is formed in the comb shape, so the step portion 80 is long as compared with that in the ink guide 22 shown in FIGS. 3A to 3D. Therefore, it becomes possible to further strongly fix the meniscus and further increase the meniscus shape stability as compared with the case of the ink guide 22 of the first embodiment.

In the case of the ink guide 70 of this embodiment, the ink Q is reserved in the cutout portions 82 and is supplied to the tip end part 74 of the ink guide 70 by capillary action. Therefore, the ink guide 70 has higher ink supplying capability of than that of the ink guide 22 of the first embodiment.

As described above, with the ink guide 70 of this embodiment, it becomes possible to hold the meniscus at a higher position and supply the ink Q to the tip end part 74 more smoothly as compared with the case of the ink guide 22 of the first embodiment.

It should be noted that, needless to say, the ink jet head 12*a* of this embodiment and the image recording apparatus including the ink jet head 12*a* are capable of providing the same effect as in the first embodiment described above.

With the ink jet head 12*a* of this embodiment, the ink guide 70 can achieve higher meniscus shape stability and the ink supplying capability than the ink guide 22 of the first embodiment, and eject the ink droplets in a state where the ink Q has reached the top 76*a* of the ink guide 70. Also, the meniscus shape stability is further increased, so even when disturbances such as vibrations are given, fluctuations of the meniscus shape are further suppressed.

In the ink jet head 12*a* of this embodiment, by providing the ink guide 70, it becomes possible to further raise the position of the meniscus at the ejection port 24 and further stabilize the shape of the meniscus M, which makes it possible to further enhance the ejection frequency responsivity of the ink droplets R and the adhering position accuracy of the ink droplets R, eject the ink droplet R of a predetermined size while reducing variations in size of the ink droplets R, and further increase the ink droplet ejection property.

In the image recording apparatus including the ink jet head 12*a* of this embodiment, at each ejection port 24, the meniscus is held at a higher position and the ink Q is further sufficiently supplied from the cutout portions 82 of the step portion 80 to the top 76*a*. Therefore, it becomes possible to further enhance the ejection frequency responsivity. As a result, it becomes possible to perform image recording at higher speed.

Further, in the image recording apparatus including the ink jet head 12*a* of this embodiment, a further superior meniscus shape stability is achieved, so it becomes possible to perform higher-quality image recording. Still further, when color images are formed, it becomes possible to perform high-quality image recording by further suppressing color drift.

Next, the ink Q used in the above-described image recording apparatus of the first and the second embodiments of the present invention will be described.

The ink Q is obtained by dispersing colorant particles in a carrier liquid. The carrier liquid is preferably a dielectric liquid (non-aqueous solvent) having a high electrical resistivity (equal to or larger than $10^9$ Ω·cm, and preferably equal to or larger than $10^{10}$ Ω·cm). If the electrical resistance of the carrier liquid is low, the concentration of the colorant particles does not occur since the carrier liquid receives the injection of electric charges and is charged due to a drive voltage applied to the ejection electrodes. In addition, since there is also anxiety that the carrier liquid having a low electrical resistance causes the electrical conduction between adjacent ejection electrodes, the carrier liquid having a low electrical resistance is unsuitable for the present invention.

The relative permittivity of the dielectric liquid used as the carrier liquid is preferably equal to or smaller than 5, more preferably equal to or smaller than 4, and much more preferably equal to or smaller than 3.5. Such a range is selected for the relative permittivity, whereby an electric field effectively acts on the colorant particles contained in the carrier liquid to facilitate the electrophoresis of the colorant particles.

Note that the upper limit of the specific electrical resistance of the carrier liquid is desirably about $10^{16}$ Ω·cm, and the lower limit of the relative permittivity is desirably about 1.9. The reason why the electrical resistance of the carrier liquid preferably falls within the above-mentioned range is that if the electrical resistance becomes low, then the ejection of ink under a low electric field becomes worse. Also, the reason why the relative permittivity preferably falls within the above-mentioned range is that if the relative permittivity becomes high, then an electric field is relaxed due to the polarization of a solvent, and as a result the color of dots formed under this condition becomes light, or the bleeding occurs.

Preferred examples of the dielectric liquid used as the carrier liquid include straight-chain or branched aliphatic hydrocarbons, alicyclic hydrocarbons, aromatic hydrocarbons, and the same hydrocarbons substituted with halogens. Specific examples thereof include hexane, heptane, octane, isooctane, decane, isodecane, decalin, nonane, dodecane, isododecane, cyclohexane, cyclooctane, cyclodecane, benzene, toluene, xylene, mesitylene, Isopar C, Isopar E, Isopar G, Isopar H, Isopar L, Isopar M (Isopar: a trade name of EXXON Corporation), Shellsol 70, Shellsol 71 (Shellsol: a trade name of Shell Oil Company), AMSCO OMS, AMSCO 460 Solvent (AMSCO: a trade name of Spirits Co., Ltd.), a silicone oil (such as KF-96L, available from Shin-Etsu Chemical Co., Ltd.). The dielectric liquid may be used singly or as a mixture of two or more thereof.

For such colorant particles dispersed in the carrier liquid, colorants themselves may be dispersed as the colorant particles into the carrier liquid, but dispersion resin particles are preferably contained for enhancement of the fixing property. In the case where the dispersion resin particles are contained in the carrier liquid, in general, there is adopted a method in which pigments are covered with the resin material of the dispersion resin particles to obtain particles covered with the resin, or the dispersion resin particles are colored with dyes to obtain the colored particles.

As the colorants, pigments and dyes conventionally used in ink compositions for ink jet recording, (oily) ink compositions for printing, or liquid developers for electrostatic photography may be used.

Pigments used as colorants may be inorganic pigments or organic pigments commonly employed in the field of printing technology. Specific examples thereof include but are not particularly limited to known pigments such as carbon black, cadmium red, molybdenum red, chrome yellow, cadmium yellow, titanium yellow, chromium oxide, viridian, cobalt green, ultramarine blue, Prussian blue, cobalt blue, azo pigments, phthalocyanine pigments, quinacridone pigments, isoindolinone pigments, dioxazine pigments, threne pigments, perylene pigments, perinone pigments, thioindigo pigments, quinophthalone pigments, and metal complex pigments.

Preferred examples of dyes used as colorants include oil-soluble dyes such as azo dyes, metal complex salt dyes, naphthol dyes, anthraquinone dyes, indigo dyes, carbonium dyes, quinoneimine dyes, xanthene dyes, aniline dyes, quinoline dyes, nitro dyes, nitroso dyes, benzoquinone dyes, naphthoquinone dyes, phthalocyanine dyes, and metal phthalocyanine dyes.

Further, examples of the dispersion resin particles include rosins, rosin-modified phenol resin, alkyd resin, a (meth)acryl polymer, polyurethane, polyester, polyamide, polyethylene, polybutadiene, polystyrene, polyvinyl acetate, acetal-modified polyvinyl alcohol, and polycarbonate.

Of those, from the viewpoint of ease for particle formation, a polymer having a weight average molecular weight in a range of 2,000 to 1,000,000 and a polydispersity (weight average molecular weight/number average molecular weight) in a range of 1.0 to 5.0 is preferred. Moreover, from the viewpoint of ease for the fixation, a polymer in which one of a softening point, a glass transition point, and a melting point is in a range of 40° C. to 120° C. is preferred.

In the ink Q, the content of colorant particles (i.e., the total content of colorant particles and dispersion resin particles) preferably falls within a range of 0.5 to 30 wt % for the overall ink, more preferably falls within a range of 1.5 to 25 wt %, and much more preferably falls within a range of 3 to 20 wt %. If the content of the colorant particles decreases, the following problems become easy to arise. The density of a printed image is insufficient, the affinity between the ink Q and the surface of the recording medium P becomes difficult to obtain to prevent an image firmly stuck to the surface of the recording medium P from being obtained, and so forth. On the other hand, if the content of the colorant particles increases, problems occur in that the uniform dispersion liquid becomes difficult to obtain, the clogging of the ink Q is easy to occur in the ink jet head or the like to make it difficult to obtain the consistent ink ejection, and so forth.

In addition, the average particle diameter of the colorant particles dispersed in the carrier liquid preferably falls within a range of 0.1 to 5 μm, more preferably falls within a range of 0.2 to 1.5 μm, and much more preferably falls within a range of 0.4 to 1.0 μm. Those particle diameters are measured with CAPA-500 (a trade name of a measuring apparatus manufactured by HORIBA Ltd.).

After the colorant particles and optionally a dispersing agent are dispersed in the carrier liquid, a charging control agent is added to the resultant carrier liquid to charge the colorant particles, and the charged colorant particles are dispersed in the resultant liquid to thereby produce the ink Q. Note that in dispersing the colorant particles in the carrier liquid, a dispersion medium may be added if necessary.

As the charging control agent, for example, various ones used in the electrophotographic liquid developer can be utilized. In addition, it is also possible to utilize various charging control agents described in "DEVELOPMENT AND PRACTICAL APPLICATION OF RECENT ELECTRONIC PHOTOGRAPH DEVELOPING SYSTEM AND TONER MATERIALS", pp. 139 to 148; "ELECTROPHOTOGRAPHY-BASES AND APPLICATIONS", edited by THE IMAGING SOCIETY OF JAPAN, and published by CORONA PUBLISHING CO. LTD., pp. 497 to 505, 1988; and "ELECTRONIC PHOTOGRAPHY" by Yuji Harasaki, 16(No. 2), p. 44, 1977.

Note that the colorant particles may be positively or negatively charged as long as the charged colorant particles are identical in polarity to the drive voltages applied to ejection electrodes.

In addition, the charging amount of the colorant particles is preferably in a range of 5 to 200 μC/g, more preferably in a range of 10 to 150 μC/g, and much more preferably in a range of 15 to 100 μC/g.

In addition, the electrical resistance of the dielectric solvent may be changed by adding the charging control agent in some cases. Thus, the distribution factor P defined in the formula (2) given below is preferably equal to or larger than 50%, more preferably equal to or larger than 60%, and much more preferably equal to or larger than 70%.

$$P=100\times(\sigma1-\sigma2)/\sigma1 \quad (2)$$

In the above formula (2), σ1 is an electric conductivity of the ink Q, and σ2 is an electric conductivity of a supernatant liquid which is obtained by inspecting the ink Q with a centrifugal separator. Those electric conductivities were measured by using an LCR meter (AG-4311 manufactured by ANDO ELECTRIC CO., LTD.) and an electrode for liquid (LP-05 manufactured by KAWAGUCHI ELECTRIC WORKS, CO., LTD.) under a condition of an applied voltage of 5 V and a frequency of 1 kHz. In addition, the centrifugation was carried out for 30 minutes under a condition of a rotational speed of 14,500 rpm and a temperature of 23° C. using a miniature high speed cooling centrifugal machine (SRX-201 manufactured by TOMY SEIKO CO., LTD.).

The ink Q as described above is used, which results in that the colorant particles are likely to migrate and hence the colorant particles are easily concentrated.

The electric conductivity of the ink Q is preferably in a range of 100 to 3,000 pS/cm, more preferably in a range of 150 to 2,500 pS/cm, and much more preferably in a range of 200 to 2,000 pS/cm. The range of the electric conductivity as described above is set, resulting in that the applied voltages to the ejection electrodes are not excessively high, and also there is no anxiety to cause the electrical conduction between adjacent ejection electrodes.

In addition, the surface tension of the ink Q is preferably in a range of 15 to 50 mN/m, more preferably in a range of 15.5 to 45 mN/m, and much more preferably in a range of 16 to 40 mN/m. The surface tension is set in this range, resulting in that the applied voltages to the ejection electrodes are not excessively high, and also ink does not leak or spread to the periphery of the head to contaminate the head.

Moreover, the viscosity of the ink Q is preferably in a range of 0.5 to 5 mPa·sec, more preferably in a range of 0.6 to 3.0 mPa·sec, and much more preferably in a range of 0.7 to 2.0 mPa·sec.

The ink Q can be prepared for example by dispersing colorant particles into a carrier liquid to form particles and adding a charging control agent to a dispersion medium to allow the colorant particles to be charged. The following methods are given as the specific methods.

(1) A method including: previously mixing (kneading) a colorant and optionally dispersion resin particles; dispersing the resultant mixture into a carrier liquid using a dispersing agent when necessary; and adding a charging control agent thereto.

(2) A method including: adding a colorant and optionally dispersion resin particles and a dispersing agent into a carrier liquid at the same time for dispersion; and adding a charging control agent thereto.

(3) A method including adding a colorant and a charging control agent and optionally a dispersion resin particles and a dispersing agent into a carrier liquid at the same time for dispersion.

Next, the evaluation of the meniscus height and the ink ejection property was done for the cases of the ink guide 22 of the first embodiment shown in FIG. 3A, the ink guide 70 of the second embodiment shown in FIG. 15A, the conventional ink guide 250 shown in FIG. 16A, and the conventional ink guide 204 shown in FIG. 17. As to the meniscus height, whether the ink has reached the tip end of the ink guide was evaluated. The meniscus height was evaluated as "A" when the ink has reached the tip end of the ink guide and as "B" when the ink did not reach the tip end of the ink guide.

As to the ink ejection property, a dot size, ink adhering position accuracy, responsivity, and the like at the time of ink ejection were comprehensively evaluated. The ink ejection property was evaluated as "A" when the ejection property was extremely superior, as "B" when the ejection property was superior, and as "C" when the ink was not sufficiently ejected or the ink ejection was impossible. These results are shown in Table 1 given below. In Table 1, Example 1 refers to the ink guide 22 of the first embodiment, Example 2 to the ink guide 70 of the second embodiment, Comparative Example 1 to the conventional ink guide 250, and Comparative Example 2 to the conventional ink guide 204.

In Comparative Example 1 (ink guide 250), the overall height was 580 μm, the overall width was 210 μm, and the thickness was 50 μm.

In Comparative Example 2 (ink guide 204), the overall height was 580 μm, the overall width was 210 μm, and the thickness was 50 μm. In addition, the width of the ink guide groove 220 was 50 μm.

TABLE 1

| | Evaluation item | |
|---|---|---|
| | Meniscus height | Ink ejection property |
| Example 1 | A | B |
| Example 2 | A | A |
| Comparative Example 1 | B | C |
| Comparative Example 2 | A | C |

As shown in Table 1 given above, with each of the ink guide 22 of the first embodiment of the present invention (Example 1) and the ink guide 70 of the second embodiment of the present invention (Example 2), a meniscus height reaching the tip end was obtained. The ink guide 22 of the first embodiment of the present invention was also superior in ink ejection property and the ink guide 70 of the second embodiment was further superior in ink ejection property.

On the other hand, with the conventional ink guide 250 (Comparative Example 1), a sufficient meniscus height was not obtained and ink ejection was impossible.

With the conventional ink guide 204 (Comparative Example 2), a meniscus height reaching the tip end was obtained and ink ejection was possible. In this case, however, the obtained dot size and ink droplet adhering position accuracy were insufficient.

The ink jet head and the image recording apparatus according to the present invention have been described above in detail by giving various embodiments and examples, but the present invention is not limited to the embodiments and examples described above, and it is of course possible to make various changes and modifications without departing from the gist of the present invention.

What is claimed is:

1. An ink jet head that ejects ink droplets by exerting an electrostatic force on ink having dispersed charged particles, comprising:

an insulating ejection substrate in which through holes for ejecting the ink droplets are formed;

ejection electrodes, each being arranged in each of said through holes, respectively, and exerting the electrostatic force on the ink; and ink guides, each passing through each of said through holes, respectively, and protruding from an ink droplet ejection side of said insulating ejection substrate, wherein each of said ink guides comprises a flat plate shaped support part and a flat plate shaped tip end part that extends from an end portion of said support part having a predetermined thickness and is directed toward the ink droplet ejection side, said tip end part is formed so that a back surface of said tip end part is flush with a back surface of said support part, and said tip end part is thinner than said support part to form a step on a front surface side and is gradually narrowed toward the ink droplet ejection side, and said electrostatic force exerted on the ink has at least a component directed toward a tip end of an ink guide along said tip end part.

2. The ink jet head according to claim 1, wherein said ink guide comprises a member having a dielectric constant distribution.

3. The ink jet head according to claim 1, wherein said ink guide is formed of at least two kinds of materials with different dielectric constants.

4. The ink jet head according to claim 1, wherein at least an extreme tip end region including an extreme tip end of said tip end part of said ink guide is formed of a material having a relatively higher dielectric constant than that of the other regions of said ink guide.

5. The ink jet head according to claim 1, wherein an extreme tip end region including an extreme tip end of said tip end part of said ink guide is a high dielectric constant region that has a relatively higher dielectric constant than that of the other regions of said ink guide, and is approximately equal to or smaller in size than said ink droplets ejected from said tip end part.

6. The ink jet head according to claim 1, wherein a root region including a root of said support part of said ink guide is formed of a material having a relatively higher dielectric constant than that of the other regions of said ink guide.

7. The ink jet head according to claim 1, wherein an extreme tip end region including an extreme tip end of said tip end part and a root region of said support part in said ink guide are formed of a material having a relatively higher dielectric constant than that of other regions of said ink guide.

8. The ink jet head according to claim 7, wherein said extreme tip end region including said extreme tip end of said tip end part of said ink guide is a high dielectric constant region that has a relatively higher dielectric constant than that of the other regions of said ink guide, and is approximately equal to or smaller in size than the ink droplets ejected from said tip end part.

9. The ink jet head according to claim 8, wherein said tip end of said support part from which said tip end part of said ink guide extends and at which the step is formed has a shape approximately similar to said tip end shape.

10. The ink jet head according to claim 1, wherein a tip of said tip end part of said ink guide has a radius of curvature of 2 μm or more.

11. The ink jet head according to claim 1, wherein a difference in thickness between said support part and said tip end part is 20 μm or more.

12. An image recording apparatus comprising:

an ink jet head that ejects ink droplets by exerting an electrostatic force on ink having dispersed charged particles, comprising:

an insulating ejection substrate in which through holes for ejecting the ink droplets are formed;

ejection electrodes, each being arranged in each of said through holes, respectively, and exerting the electrostatic force on the ink; and ink guides, each passing through each of said through holes, respectively, and protruding from an ink droplet ejection side of said insulating ejection substrate, wherein each of said ink guides comprises a flat plate shaped support part and a flat plate shaped tip end part that extends from an end portion of said support part having a predetermined thickness and is directed toward the ink droplet ejection side, said tip end part is formed so that a back surface of said tip end part is flush with a back surface of said support part, and said tip end part is thinner than said support part to form a step on a front surface side and is gradually narrowed toward the ink droplet ejection side, said electrostatic force exerted on the ink has at least a component directed toward a tip end of an ink guide along said tip end part, and an image according to an image data is recorded on a recording medium.

* * * * *